US007681875B2

(12) United States Patent
Asada et al.

(10) Patent No.: US 7,681,875 B2
(45) Date of Patent: Mar. 23, 2010

(54) SUPPLY TRAY AND IMAGE FORMING APPARATUS FOR USE THEREWITH

(75) Inventors: Tetsuo Asada, Kuwana (JP); Yukio Shiohara, Nagoya (JP); Keisuke Wakakusa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 201 days.

(21) Appl. No.: 11/670,925

(22) Filed: Feb. 2, 2007

(65) Prior Publication Data

US 2007/0182803 A1 Aug. 9, 2007

(30) Foreign Application Priority Data

Feb. 3, 2006 (JP) ..... 2006-027292
Dec. 26, 2006 (JP) ..... 2006-350254

(51) Int. Cl.
*B65H 3/44* (2006.01)

(52) U.S. Cl. ..... 271/9.08; 271/9.07; 271/9.11

(58) Field of Classification Search ..... 271/9.01, 271/9.05, 9.06, 9.07, 9.08, 9.09, 9.11, 9.02, 271/9.13; 400/605, 624
See application file for complete search history.

(56) References Cited

U.S. PATENT DOCUMENTS 4,449,705 A * 5/1984 Shibuya et al. ..... 271/9.09
5,120,040 A * 6/1992 Worley ..... 271/9.07
5,695,182 A * 12/1997 Sekine ..... 271/9.09
5,711,517 A * 1/1998 Kelly ..... 271/4.01
5,737,682 A * 4/1998 Yamagishi ..... 399/402
6,152,440 A * 11/2000 Yip et al. ..... 271/9.11
6,406,201 B1 * 6/2002 Beretta et al. ..... 400/605
6,659,444 B2 * 12/2003 Kawarama ..... 271/9.09
7,584,950 B2 * 9/2009 Asada et al. ..... 271/9.07
2005/0242485 A1 11/2005 Shiohara et al.
2006/0163796 A1 * 7/2006 Shiohara et al. ..... 271/9.01
2006/0180976 A1 * 8/2006 Shin ..... 271/9.07

FOREIGN PATENT DOCUMENTS

JP H03-095038 A 4/1991
JP H06-049439 U 7/1994
JP H07-025489 A 1/1995
JP H07-157103 A 6/1995
JP 2005-314067 A 11/2005
JP 2006-008377 A 1/2006

* cited by examiner

*Primary Examiner*—Kaitlin S Joerger
(74) *Attorney, Agent, or Firm*—Baker Botts, LLP.

(57) ABSTRACT

A supply tray includes a first tray configured to receive a stack of recording medium thereon, and a second tray configured to receive at least one recording medium thereon, which is different in size or type, or both, from the stack of recording medium received on the first tray. The second tray is disposed in an upper portion of the first tray and is slidable within a predetermined direction. The supply tray further includes a locking mechanism configured to place and to fix the second tray in position with respect to the first tray.

23 Claims, 20 Drawing Sheets

SUPPLY TRAY AND IMAGE FORMING APPARATUS FOR USE THEREWITH

CROSS REFERENCE TO RELATED APPLICATION

This application claims priority from Japanese Patent Application Nos. 2006-027292, filed Feb. 3, 2006, and 2006-350254, filed Dec. 26, 2006, the entire subject matters of which are incorporated herein by reference.

BACKGROUND OF THE INVENTION

1. Field of the Invention

The invention relates to a supply tray configured to receive and store a stack of recording mediums and to supply the recording mediums one-by-one to an image forming apparatus and, more particularly, to a supply tray having a plurality of tiers arranged one above the next, and an image forming apparatus for use therewith.

2. Description of Related Art

A known image forming apparatus, such as a printer, includes a recording medium storing portion for receiving and storing recording mediums, such as sheets of paper therein. The image forming apparatus is configured to feed a recording medium stored in the recording medium storing portion to a location at which an image is formed on the recording medium. The image forming apparatus may include a supply roller configured to feed a recording medium, which is stored in the recording medium storing portion, onto a feed path.

Such an image forming apparatus includes a guide plate for manual feeding, which is provided in an upper portion of the recording medium storing portion. The guide plate for manual feeding is disposed slidably in the upper portion of the recording medium storing portion and is configured to receive a stack of recording mediums.

For example, in the image forming apparatus including the recording medium storing portion, when the user only wants to form an image on a recording medium that requires manual feeding, the user places a recording medium on the guide plate for manual feeding, which is disposed in the upper portion of the recording medium storing portion, and slides the guide plate to an optimum position at which the supply roller may feed or take up the recording medium. According to such a structure, even when an image is formed on a recording medium which is different in size or type, or both, from that stored in the recording medium storing portion, there is no need to replace the recording medium in the recording medium storing portion. Thus, the user may save time and labor, and image formation may be efficiently performed.

SUMMARY OF THE INVENTION

Nevertheless, in the structure described above, when an image is formed on a recording medium that requires the manual feeding, the user must slide the guide plate precisely to an optimum position at which the recording medium may be fed or taken up by the supply roller. Even if the user slides the guide plate to the optimum position, the guide plate may slide away spontaneously from the optimum position due to an external force, such as vibration and impact. If the guide plate does not reach or remain at the optimum position, the supply roller does not feed or take up the recording medium, resulting in a feeding failure. Thus, a reliable recording medium storing portion is not provided.

In an embodiment of this invention, a supply tray is provided which comprises a guide plate that is slidably disposed in an upper portion of the supply tray and that is configured to reliably feed a recording medium, which is different in size or type, or both, from that loaded on the supply tray. The supply tray for use in an image forming apparatus may comprise a first tray configured to receive a stack of first recording mediums thereon, a second tray disposed in an upper portion of the first tray, such that the second tray is slidable in a predetermined direction, the second tray configured to receive at least one, second recording medium thereon, wherein the first recording medium is a different size, or type, or both, from the second recording medium; and a locking mechanism configured to secure the second tray at a predetermined position with respect to the first tray.

In another embodiment of the invention, a supply tray may comprise a first tray means for receiving a stack of first recording mediums thereon, a second tray means for receiving at least one, second recording medium thereon, wherein the first recording medium is a different size or type, or both, from the second recording medium, the second tray means disposed in an upper portion of the first tray means in a predetermined direction; and means for locking the second tray means in position with respect to the first tray means.

In still another embodiment, an image forming apparatus for use with such a supply tray is provided.

Further objects, features, and advantages of the present invention will be understood from the following detailed description of preferred embodiments of the present invention with reference to the accompanying drawings

BRIEF DESCRIPTION OF THE DRAWINGS

Embodiments of the invention now are described with reference to the accompanying drawings, which are given by way of example only, and are not intended to limit the present invention.

DETAILED DESCRIPTION OF PREFERRED EMBODIMENTS

A first embodiment of the invention is described in detail with reference to the accompanying drawings.

Figure 1:
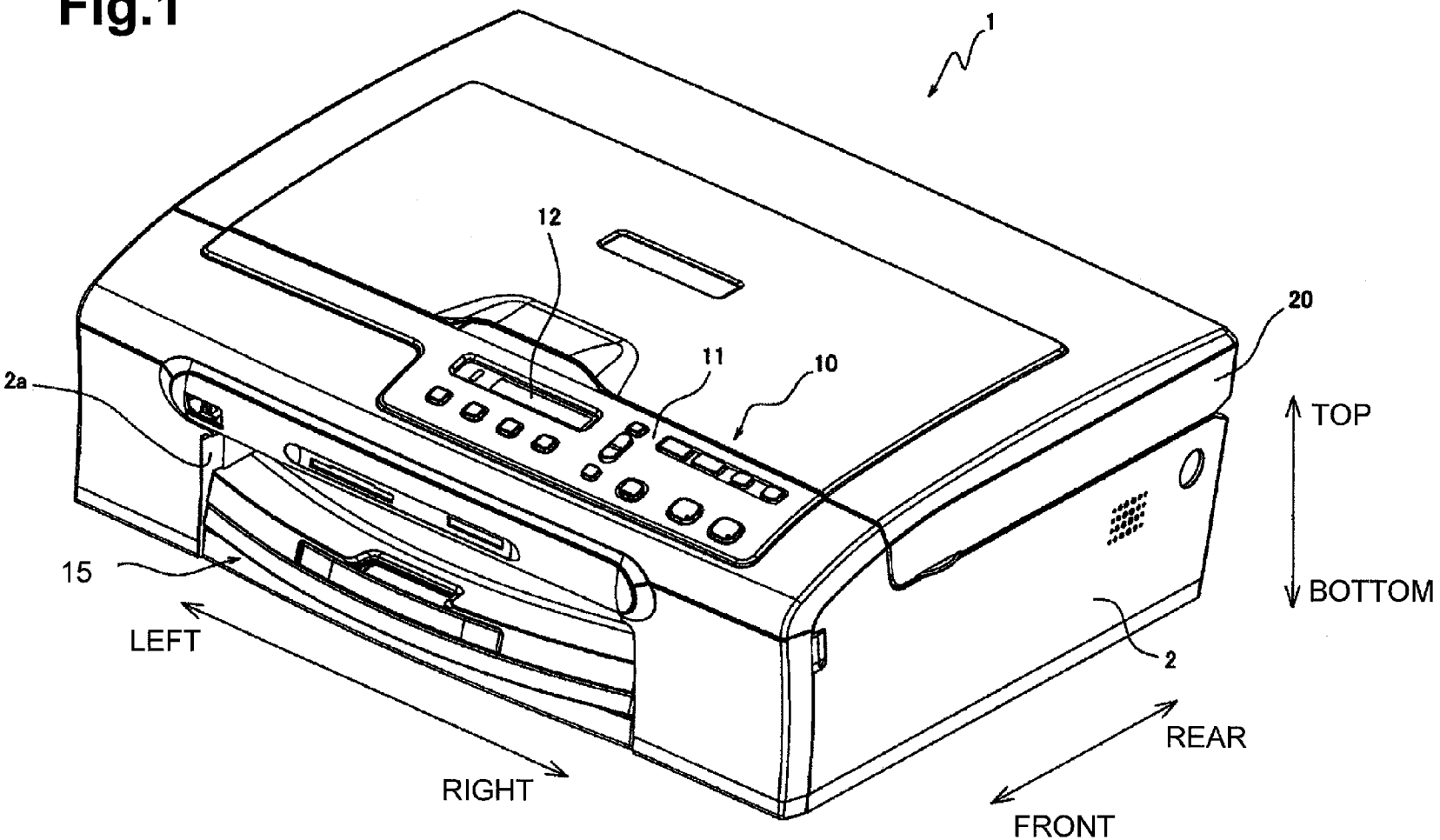
FIG. 1 is a perspective view of an image forming apparatus according to an embodiment of the invention.

In the following description, the top and bottom sides of an image forming apparatus 1 are indicated with reference to FIG. 1 in which image forming apparatus 1 is in usual service conditions. The side of image forming apparatus 1, on which an operation panel 10 is provided, is referred to as the front, and the side substantially opposite to the side on which operation panel 10 is provided is referred to as the rear. The right and left sides of image forming apparatus 1 are defined when image forming apparatus 1 is viewed from the front side.

A general structure of image forming apparatus 1 now is described. Image forming apparatus 1 is a multi-function apparatus having a printer function, a scanner function, a color copy function, and a facsimile function. As shown in FIG. 1, the appearance of image forming apparatus 1 is formed by a body casing 2 which may be made of resin and shaped as a substantially rectangular solid.

On the front side of the top surface of body casing 2, operation panel 10 is provided. Operation panel 10 includes an operation portion 11 on which operation buttons are arranged and a display part 12 (e.g., a liquid crystal display) that displays messages. Behind operation panel 10, a scanner unit 20 is provided. Scanner unit 20 functions as a scanner, color copier, and a facsimile.

Figure 2:
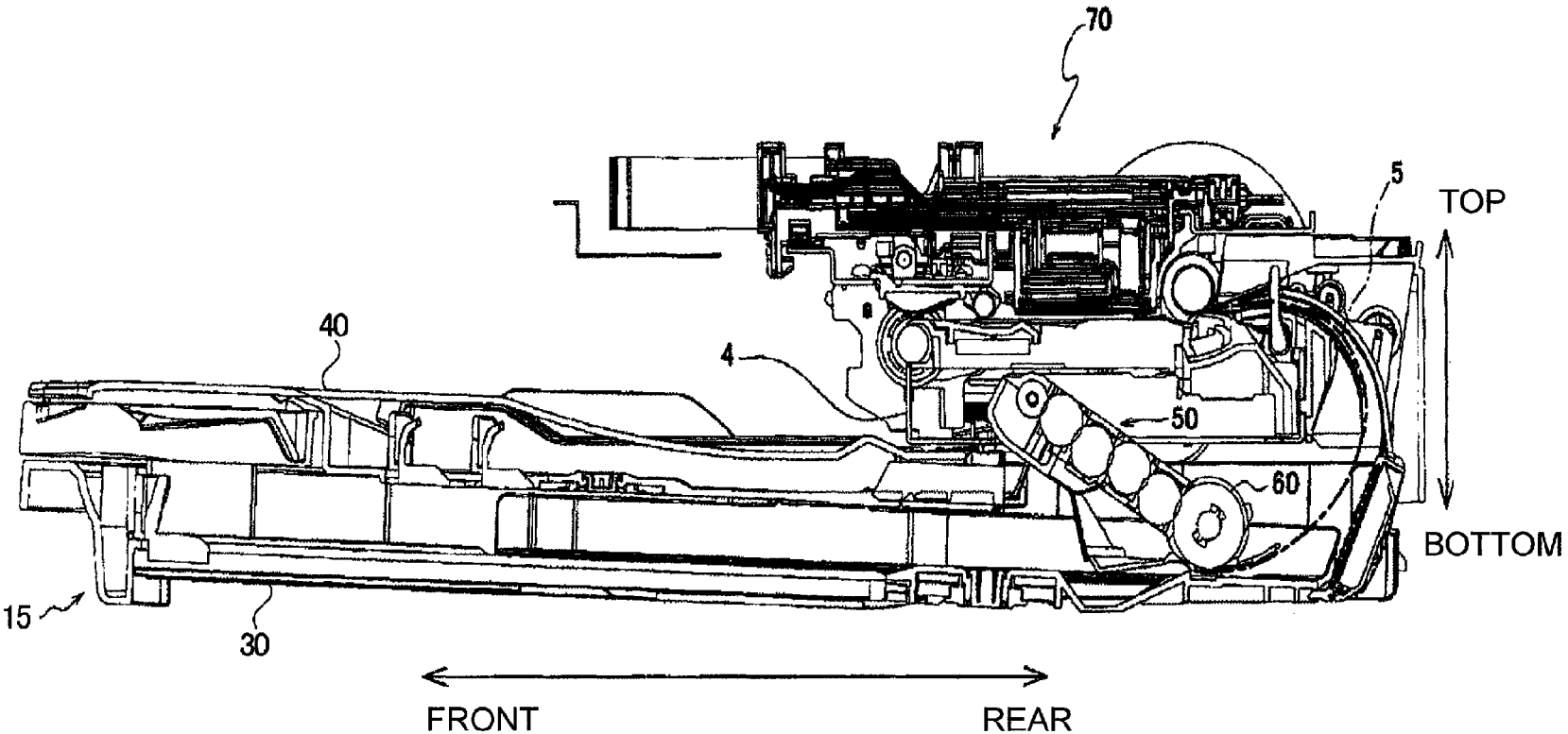
FIG. 2 is a cross-sectional view showing a structure of a main casing.

In the lower portion of body casing 2, a supply tray 15 is provided as shown in FIG. 2. Supply tray 15 is configured to receive and store a stack of recording mediums, such as paper or plastic sheets, in a substantially horizontal orientation. Supply tray 15 is removed or withdrawn substantially horizontally and frontward from body casing 2 via an opening 2*a* formed at the front side thereof. Supply tray 15 is inserted substantially horizontally and rearward into body case 2 via opening 2*a*.

A frame 4 (FIG. 2) is provided at the rear of body casing 2 and above supply tray 15. Frame 4 may be made of metal and shaped in the form of a box extending in the left-right directions. Frame 4 supports a supply unit 50, so that supply unit 50 is disposed at the rear of and above supply tray 15. Supply unit 50 includes a supply roller 60, which is configured to feed the recording mediums stored in supply tray 15, one-by-one, to a feed path 5 disposed at the rear of supply roller 60. Feed path 5 is formed at the rear of body casing 2 to guide a recording medium fed backward from supply tray 15 to the front by inverting the recording medium upward. An image recording unit 70 is disposed above supply unit 50. Image recording unit 70 is configured to record (print) an image onto the recording medium fed into feed path 5. The recording medium on which an image is printed in image recording unit 70 is ejected to the front side of the top surface of supply tray 15 (to a front side of a second tray 40 which is described below).

Figure 3:
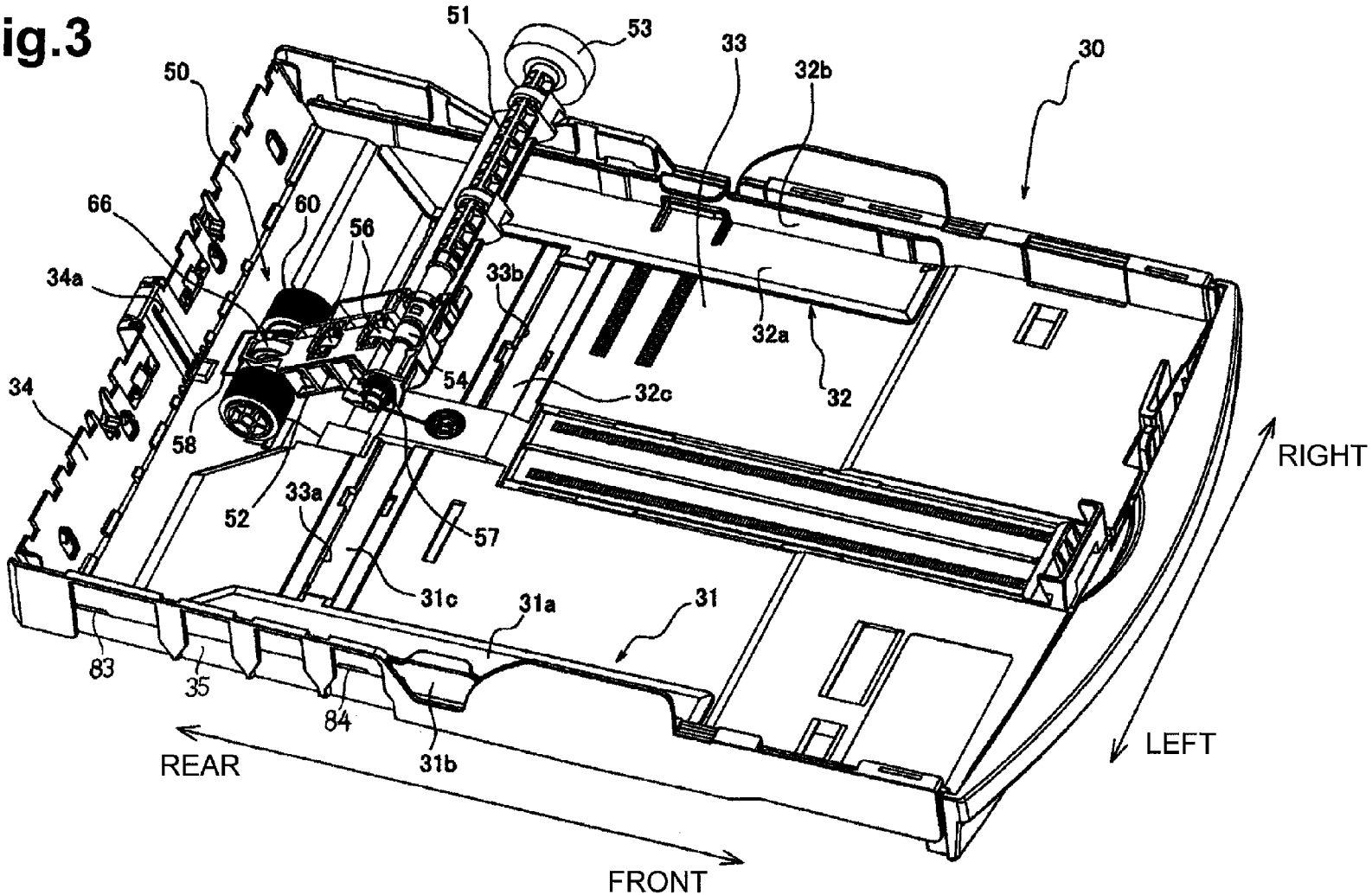
FIG. 3 is a perspective view of a main tray and a supply unit.
Figure 4:
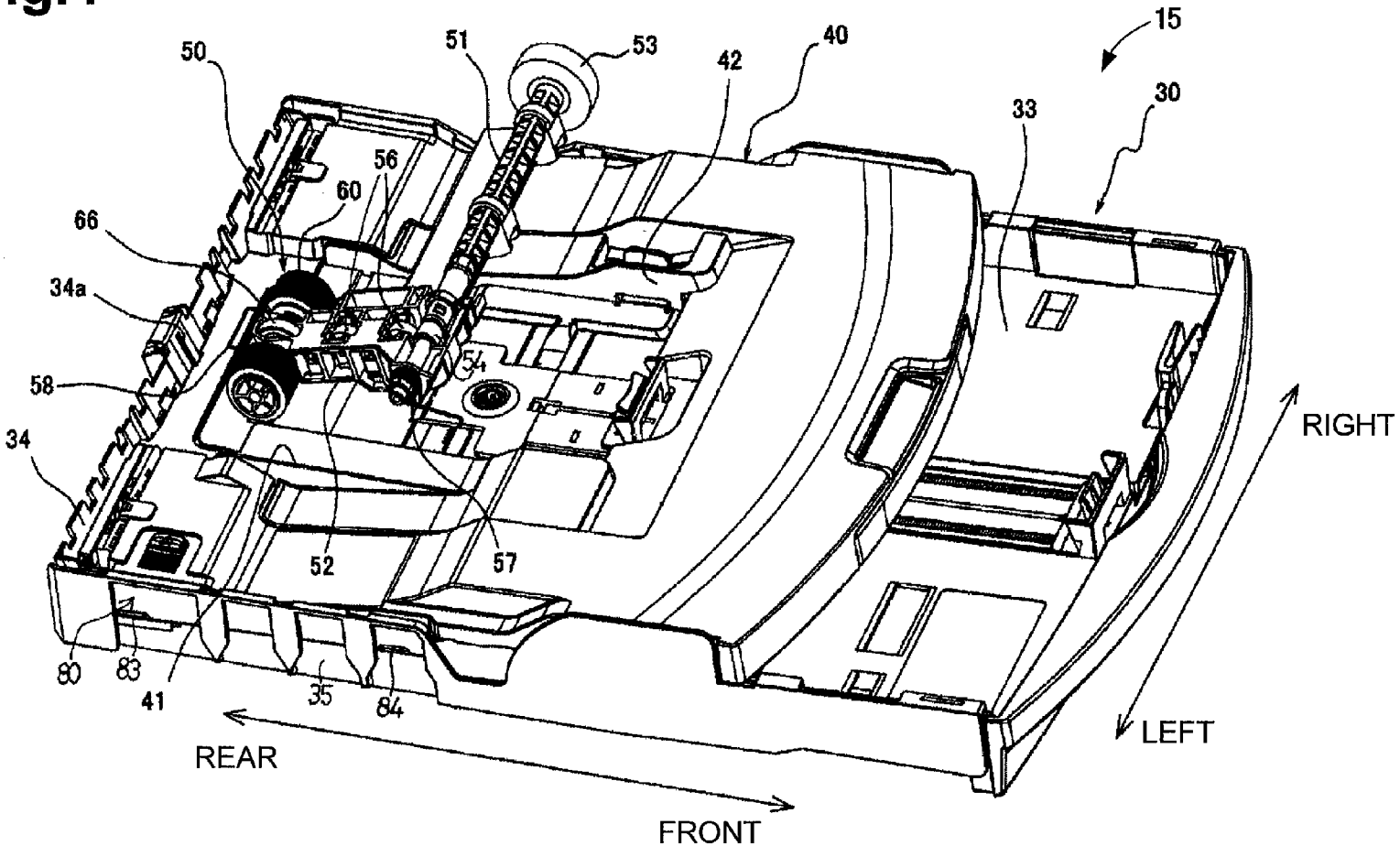
FIG. 4 is a-perspective view of the supply unit of FIG. 4 and a supply tray in which a second tray is mounted on the main tray of FIG. 4.
Figure 5:
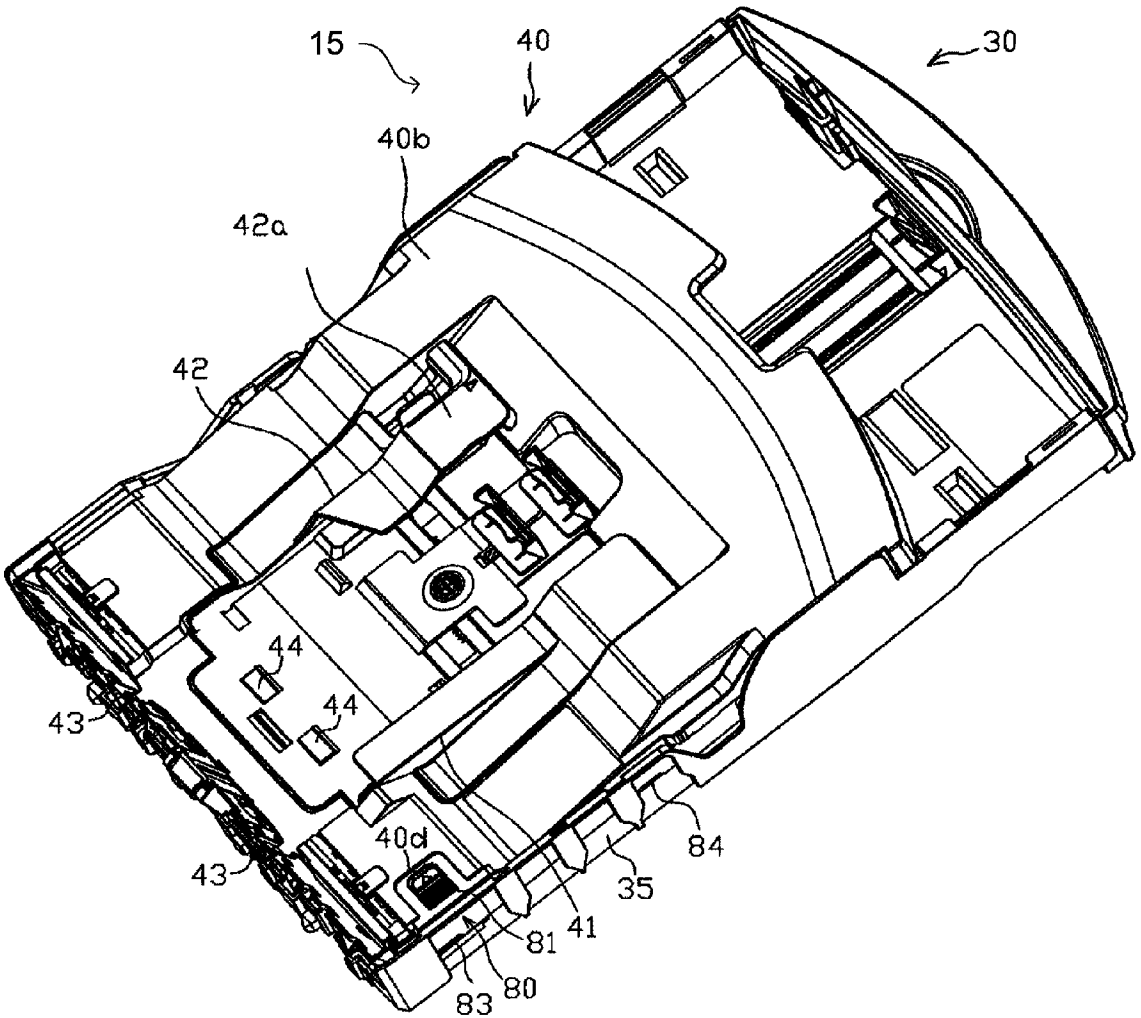
FIG. 5 is a perspective view of the supply tray of FIG. 4.

Supply tray 15 includes main tray 30 and a second tray 40 as shown in FIGS. 4 and 5. Main tray 30 may be made of resin and may be formed in a substantially A4-sized rectangular shape when it is viewed from top, as shown in FIGS. 3-5. Main tray 30 is configured to receive and store a stack of recording mediums therein. Main tray 30 includes a pair of side edge guides 31, 32 on the right and left sides, which are configured to guide the recording mediums in position, so that their centerline, with respect to their width or the left-right directions, is fixed regardless of recording medium size. Side edge guides 31, 32 are formed with sheet mount plate portions 31*a*, 32*a* and side plate portions 31*b*, 32*b*, respectively. The recording mediums are placed on the top surfaces of sheet mount plate portions 31*a*, 32*a*. Side plate portions 31*b*, 32*b* extend vertically from outer sides of sheet mount plate portions 31*a*, 32*a*. On bottom surfaces of the corresponding sheet mount plate portions 31*a*, 32*a*, linear guide bars 31*c*, 32*c* extend toward the opposite side edge guides 31, 32. Linear guide bars 31*c*, 32*c* are disposed in parallel to and separate from each other with respect to the front-rear directions, and are engaged in grooves 33*a*, 33*b* provided in a bottom plate 33 of main plate 30 along the left-right directions. Side edge guides 31, 32 are configured to move in the left-right directions by sliding linear guide bars 31*c*, 32*c* along grooves 33*a*, 33*b*. Linear guide bars 31*c*, 32*c* are formed with rack gears on their opposing sides, the rack gears engage a pinion gear that is rotatably disposed at the center of bottom plate 33 with respect to the left-right directions. Side edge guides 31, 32 are linked to each other via the rack gears and the pinion gear, and operate together, so that a distance from each of side edge guides 31, 32 to the centerline of main tray 30 with respect to the left-right directions is equal (i.e., side edge guides 31, 32 move symmetrically) at all times. Thus, the recording mediums may be placed in position, so that their centerline with respect to the left-right directions is fixed. With respect to side plate portions 31*b*, 32*b*, portions contacting the left and right edges of the recording mediums are shaped to have an even surface parallel along the front-rear directions (or a direction in which the recording mediums are fed, hereinafter referred to as the sheet feeding direction). Thus, the recording mediums positioned by side edge guides 31, 32 in main tray 30 are prevented from skewing in the left-right directions (which is a direction of an axis of rotation of supply roller 60), so that the recording mediums may be fed in a fixed direction.

Main tray 30 includes a bank 34 at the rear end. In the middle of bank 34 with respect to the left-right directions, a metal separation member 34*a* is provided. Separation member 34*a* comprises a plurality of teeth spaced vertically, and an end of each tooth protrudes slightly from the front surface of bank 34. With this structure, a stack of recording mediums pushed out by supply roller 60 of supply unit 50 contacts the ends of the teeth, and an uppermost one of the recording mediums is separated from the stack of recording mediums. Bank 34 further includes notches 34*b* (FIG. 6) configured to engage with catches 43 of sliding portion 40*a*.

Figure 6:
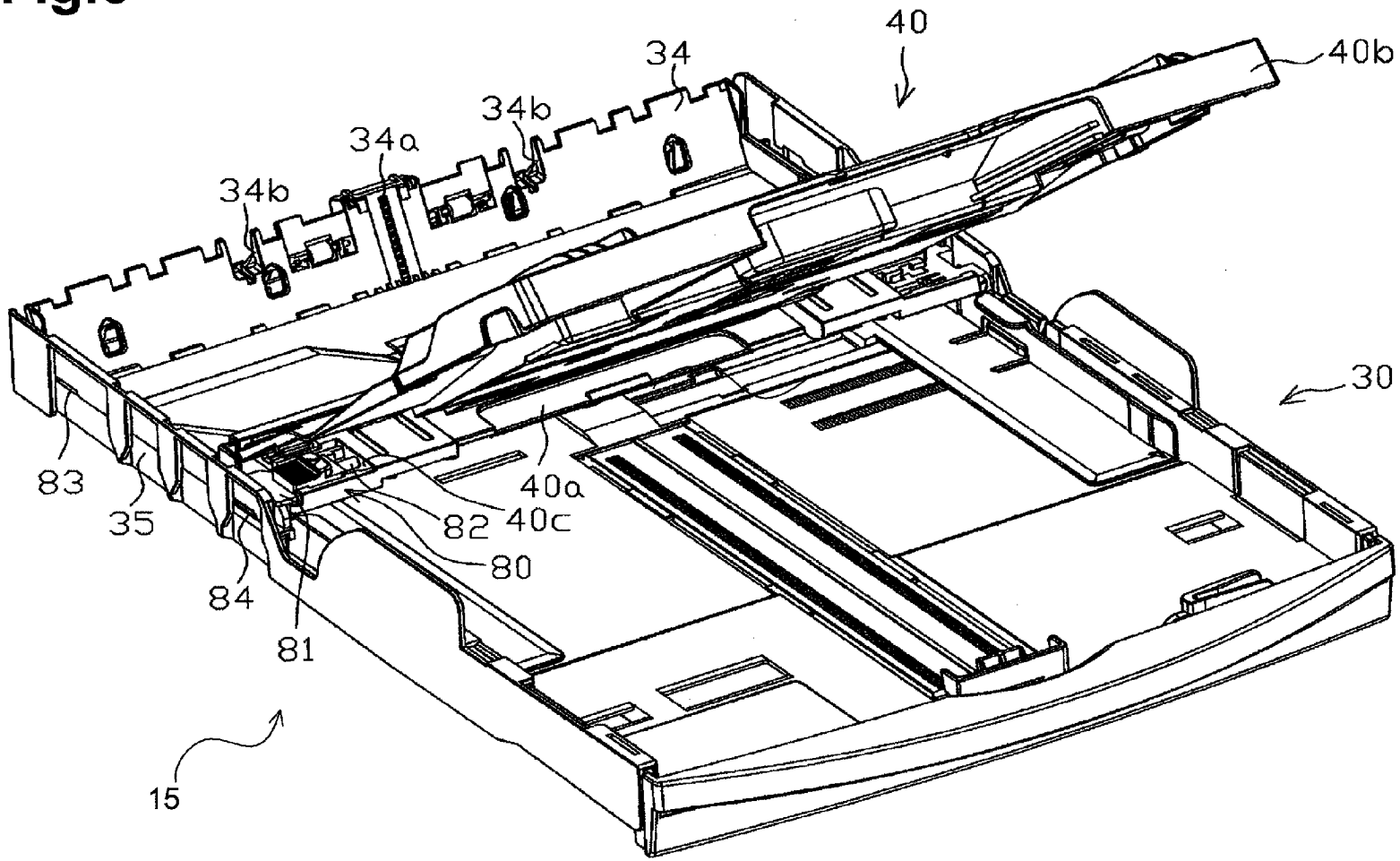
FIG. 6 is a perspective view of the supply tray of FIG. 4, in which a pivotable portion of the second tray is pivoted upwards.

Second tray 40 is slidably disposed on main tray 30 as shown in FIG. 4. Second tray 40 may be made of resin and is formed in a substantially rectangular shape of which width (e.g., the dimension in the left-right directions) is substantially the same as that of main tray 30, and the length of second tray 40 is less than that of the main tray 30. Second tray 40 is configured to receive and store a stack of thick and small-sized recording mediums, such as postcards and envelopes or the like, in its central portion with respect to the left-right directions, and serves as a guide plate. As with main tray 30, second tray 40 comprises a pair of side edge guides 41, 42 on the right and left sides, which are configured to bring the recording mediums into position, so that their centerlines, with respect to their width or the left-right directions, are fixed regardless of recording medium size. More specifically, second tray 40 comprises a sliding portion 40*a* and a pivotable portion 40*b*, as shown in FIG. 6. Sliding portion 40*a* is a plate-like member having a substantially same width as main tray 30, and slidably engages with main tray 30. Pivotable portion 40*b* also is a plate-like member having a substantially same width as main tray 30, is configured to pivot on sliding portion 40*a*, and includes a portion on which the recording mediums are placed. Side edge guides 41, 42 are attached to pivotable portion 40*b*. A visor portion 42*a* overhangs side edge guide 42, as shown in FIG. 5. In FIG. 4, visor portion 42*a* is omitted to clearly show a side surface of side edge guide 42 with which the side edge of a recording medium comes into contact.

The rear end of sliding portion 40*a* of second tray 40 comprises two catches 43, which are substantially L-shaped and configured to be inserted into and engaged by notches 34*b* formed in bank 34. Catches 43 are inserted into and engaged by notches 34*b* of bank 34, so that second tray 40 is positioned for usual service condition. In this position, catches 43 are embedded into corresponding notches 34*b* and do not protrude from the front face of bank 34. When a recording medium is supplied from second tray 40, the recording medium contacts separation member 34*a* of bank 34, but does not contact catches 43. Thus, a recording medium is separated from the stack of recording mediums in second tray 40 and supplied one-by-one. Moreover, catches 43 operate as follows. For example, a user may pivot pivotable portion 40*b* upward to replenish main tray 30 with recording mediums. In this case, even when pivotable portion 40*b* is pivoted with the recording mediums loaded on second tray 40, the recording mediums are restrained by catches 43 and do not slip off second tray 40.

In a portion of second tray 40, at which the recording mediums are stored, friction producing members 44 (e.g., a cork) are provided to oppose supply roller 60. The operation of friction producing members 44 is known and, thus, its further description is omitted here. When second tray 40 is in the service condition and stores no recording mediums thereon, friction producing members 44 contact supply roller 60. When second tray 40 is in service condition and stores a stack of recording mediums, supply roller 60, friction producing members 44, bank 34 and separation member 34*a* work together, and a recording medium is separated from the stack of recording mediums and is supplied one-by-one from the stack. Thus, if any of these members does not operate properly, normal feeding of the recording medium may become impaired and the recording medium may be damaged (e.g., ripped).

When second tray 40 is placed in a rear place (FIG. 4) of main tray 30, the recording mediums stored in second tray 40 are disposed in a position, such that the recording mediums interfere with the movement of supply roller 60 toward main tray 30 (e.g., downward). With this structure, supply roller 60 of supply unit 50 contacts the recording mediums stored in second tray 40, not in main tray 30. Thus, when an execution command, such as a copy function and a facsimile function, is input to image forming apparatus 1, a recording medium stored in second tray 40 is supplied to feed path 5. In this case, second tray 40 is not allowed to slide on main tray 30 in the front-rear direction while the recording medium is supplied, as described above. In case second tray 40 may slide readily on main tray 30 in the front-rear direction, the recording medium in second tray 40 is not properly supplied by supply unit 50. In other words, an error of supplying a recording medium or jamming may occur, and recording mediums, such as a postcard and envelope or the like, which may be expensive compared with plain paper, may be damaged (e.g., ripped). To prevent such problems, second tray 40 comprises a locking mechanism 80 configured to place and lock second tray 40 in position with respect to main tray 30. The detailed description of the locking mechanism 80 is made below.

The structure of supply unit 50 is described as follows. As shown in FIGS. 3 and 4, supply unit 50 comprises a support shaft 51, which is supported by the frame 4. Support shaft 51 is disposed from a central portion of supply tray 15 to the right end thereof along the left-right direction. A gear wheel 53 is fixed at the right end of support shaft 51. A pinion 54 having a diameter substantially the same as support shaft 51 is fixed at the left end of support shaft 51. Supply unit 50 is supported by support shaft 51, and comprises an arm member 52 that is configured to pivot on support shaft 51 with an end of arm member 52 being lowered rearward. Supply roller 60, which is rotatable on a rotation shaft thereof disposed along the left-right directions, is supported at an oscillating-side end of arm 52. In other words, arm member 52 is provided pivotally on support shaft 51 that is disposed in parallel with the rotation shaft of supply roller 60, disposed above the recording mediums stored in supply tray 15, and disposed on a side (front side) opposite to a direction at which the recording mediums are to be fed by supply roller 60 with respect to the rotation shaft of supply roller 60.

Supply roller 60 includes two rubber roller members supported at the end of arm member 52, as shown in FIGS. 3 and 4. More specifically, the end of arm member 52 is formed with a through hole (not shown) in which a rotation shaft (not shown) of the two roller members is inserted. A drive gear 66 is formed in a central portion of the rotation shaft of the two roller members with respect to the left-right directions. Drive gear 66 is configured to transmit a rotation drive force to supply roller 60. Inside arm member 52, a gear train comprised of a plurality of drive transmission gears 56 is disposed. The gear train transmits drive force from pinion 54 to drive gear 66. Thus, when a command to execute a copy function or facsimile function is input to image forming apparatus 1, drive force is transmitted from a drive source (not shown) via gear wheel 53, support shaft 51, pinion 54, drive transmission gears 56, and drive gear 66 to supply roller 60, and a recording medium loaded on main tray 30 or second tray 40 is supplied to feed path 5.

The arm member 52 is pivotal on support shaft 51 in a range from an inclined rearward position at which the rotation shaft of supply roller 60 is positioned below support shaft 51 to a horizontal position at which the rotation shaft of supply roller 60 is substantially level with the center of support shaft 51. The base end (at which support shaft 51 is provided) of arm member 52 is provided with a first torsion coil spring 57 that urges arm member 52 downward (i.e., in a direction to bring arm member 52 into contact with the uppermost recording medium stored in main tray 30) in its pivotal movement range.

Thus, supply roller 60 is pressed against the uppermost recording medium stored in main tray 30. The end of arm member 52 is provided with a second torsion coil spring 58 that urges arm member 52 downward (i.e., in a direction to increase the urging force of first torsion coil spring 57) only when arm member 52 is raised to about its horizontal position. Second torsion coil spring 58 is elastically deformed into contact with a contact part (not shown) of frame 4 to urge arm member 52. Specifically, when arm member 52 is disposed, so that supply roller 60 makes contact with the uppermost recording medium stored in second tray 40, a free end of second torsion coil spring 58 makes contact with the contact part of frame 4, and arm member 52 is urged downward.

As described above, when second tray 40 is in service condition (FIG. 4) and stores no recording mediums thereon, supply roller 60 contacts friction producing members 44.

As described above, second tray 40, which is configured to store thick and small-sized recording mediums, such as postcards and envelopes or the like, in its central portion with respect to the left-right directions, is engaged slidably with main tray 30. Second tray 40 is provided with a locking mechanism 80 configured to place and fix second tray 40 in position with respect to main tray 30.

The locking mechanism 80 is made up of a lever member 81 and spring 82, which are disposed in a cavity portion 40*c* of sliding portion 40*a* of second tray 40, and two openings 83, 84, which are provided on sidewall 35 of main tray 30.

Figure 8:
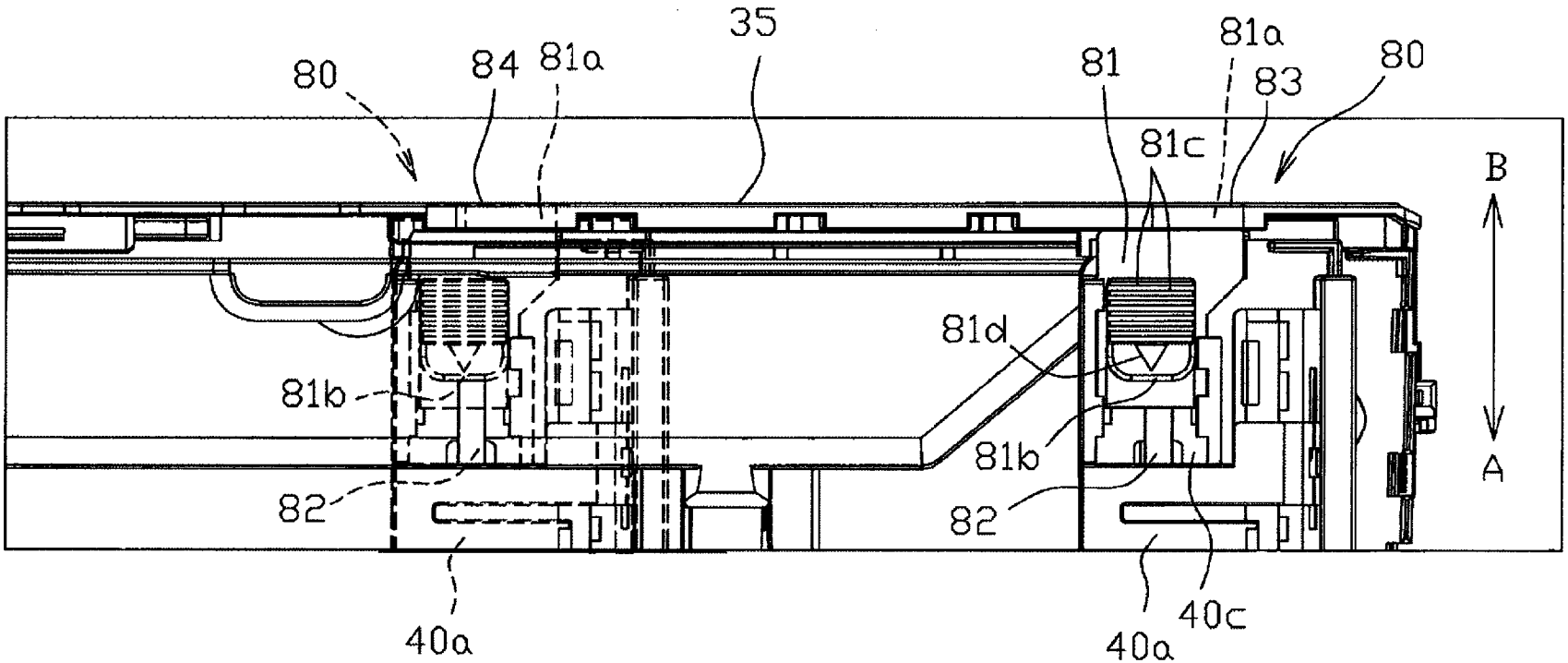
FIG. 8 is a partial, enlarged view of the sliding portion of FIG. 7.

Lever member 81 may be a resin member, and comprises an engaging portion 81*a* and an operating portion 81*b*. Lever member 81 is disposed so as to slide in cavity portion 40*c* of sliding portion 40*a* in directions A and B, as shown in FIG. 8. Lever member 81 normally is urged in direction B by spring 82. Because lever member 81 and spring 82 are disposed not in pivotable portion 40*b* of second tray 40, but in sliding portion 40*a* which is capable of only sliding with respect to main tray 30, a position from which the recording medium is supplied from second tray 40 is not shifted. Thus, when sliding portion 40*a* is secured by locking mechanism 80, sliding portion 40*a* is kept in place with respect to main tray 30 until the user releases locking mechanism 80. As described above, when second tray 40 is in service condition, supply roller 60, friction producing members 44, bank 34, and separation member 34*a* work together, and the recording medium is separated from the stack one-by-one and supplied to feed paths. Thus, if any of these members does not operate properly, normal feeding of the recording medium may be impaired, and the recording medium may be damaged (e.g., ripped). Thus, recording mediums stored in second tray 40 may be supplied as a result of which each part operates properly and cooperates with each other.

If lever member 81 and spring 82 are disposed in pivotable portion 40*b* of second tray 40, when pivotable portion 40*b* pivots due to oscillation or an external force of some kind, supply roller 60, friction producing members 44, bank 34, and separation member 34*a* may not operate properly, normal feeding of the recording medium may be impaired, and the recording medium may be damaged (e.g., ripped).

In addition, even when the user pivots pivotable portion 40*b* upward to replenish main tray 30 with recording mediums, second tray 40 may be maintained locked in place. Thus, after replenishing main tray 30 with the recording mediums, the user returns pivotable portion 40*b* to its original position and returns supply tray 15 in image forming apparatus 1, so that the last service condition of image forming apparatus 1 may be restored. Thus, operational ease may be improved.

For the above reasons, in this embodiment, lever member 81 and spring 82 are disposed in sliding portion 40*a* of second tray 40.

Engaging portion 81*a* selectively engages with either of openings 83, 84 provided on sidewall 35 of main tray 30. When engaging portion 81*a* engages with opening 83, sliding portion 40*a* of second tray 40 is positioned and fixed in a position shown by a solid line in FIGS. 7 and 8. In such a position, when an operation to supply a recording medium is executed, a recording medium loaded on second tray 40 is supplied to feed path 5. In other words, second tray 40 is in service condition. When engaging portion 81*a* engages with opening 84, sliding portion 40*a* of second tray 40 is positioned and fixed in a position shown by a broken line in FIGS. 7 and 8. In this position, when an operation to supply a recording medium is executed, a recording medium loaded on main tray 30 is supplied to feed path 5. Consequently, second tray 40 is no longer in service condition.

Operating portion 81*b* is the position on which the user may place his or her finger to slide lever member 81 in a direction of arrow A and to release locking mechanism 80. A surface of operating portion 81*b* is formed with an uneven portion 81*c* to prevent the user's finger from slipping, and an arrow mark 81, which indicates to the user a direction to move lever member 81. A surface, on which uneven portion 81*c* is formed, is provided below a surface at which arrow mark 81*d* is indicated. Consequently, there is a height difference on the surface of operating portion 81*b* (FIG. 6). Thus, the height difference also directs the user to slide lever member 81 in the direction indicated by arrow mark 81*d* (e.g., in the direction of arrow A in FIG. 8).

The operation of locking mechanism 80 is described below.

Before executing a printer function or a facsimile function at image forming apparatus 1, the user selects a size and a type of a recording medium, according to the user's need. Actually, recording mediums of appropriate sizes may be loaded on both main tray 30 and second tray 40 respectively, in advance. Nevertheless, for simplicity of description, it is assumed that the user selects a desired tray, main tray 30 or second tray 40, to form an image on the recording mediums in the desired tray. When image forming apparatus 1 is set in a state at which recording medium is not supplied from the desired tray, the user slides second tray 40 on main tray 30 so as to supply recording mediums from the desired tray. The user first may remove supply tray 15 from opening 2*a* of image forming apparatus 1 in a manner shown in FIG. 1, and then slide second tray 40 on main tray 30.

Figure 7:
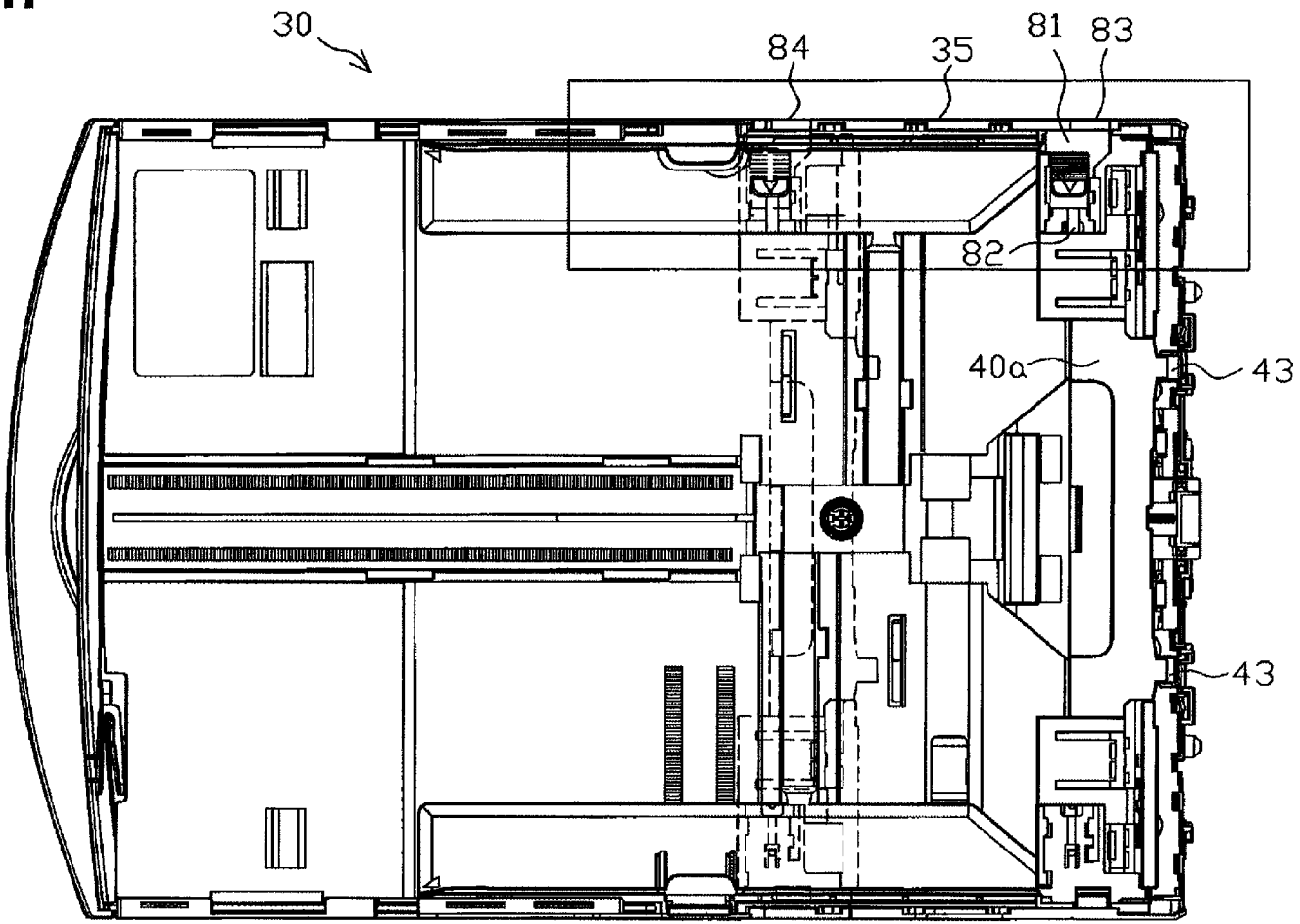
FIG. 7 is a plan view of a sliding portion of the second tray which is in a locked position on the main tray with the pivotable portion removed.

Lever member 81 normally is urged in a direction of arrow B, as shown in FIG. 8, and engages in opening 83 or 84 provided on sidewall 35 of main tray 30. Under these conditions, sliding portion 40*a* is positioned and fixed in a position shown by the solid or broken line, as shown in FIGS. 7 and 8. When the user slides second tray 40 on main tray 30, the user may place his or her finger on operating portion 81*b* of lever member 81 and slide it into the direction indicated by arrow mark 81*d* (e.g., into the direction of arrow A in FIG. 8). As pivotable portion 40*b* of second tray 40 pivots downward, as shown in FIG. 5, the user may place his or her finger on operating portion 81*b* of lever member 81, which is exposed from opening 40*d* of pivotable portion 40*b*. The user may place his or her finger on operating portion 81*b* of lever member 81 after pivoting pivotable portion 40*b* of second tray 40 until the upper portion main tray 30 is open as shown in FIG. 6.

When the user places his or her finger on operating portion 81*b* of lever member 81 and slides lever member 81 in the direction indicated by arrow mark 81*d* (e.g., in direction of arrow A in FIG. 8) against the urging force of spring 82, engaging portion 81*a* engages in either one of openings 83 and 84 and is disengaged from opening 40*d*. In this condition, second tray 40 slides on main tray 30. While continuing to slide lever member 81 in the direction of arrow A, the user may slide second tray 40 on main tray 30 in a desired direction. When second tray 40 is slid only slightly on main tray 30 with engaging portion 81*a* disengaged from opening 40*d*, engaging portion 81*a* may no longer return to opening 40*d* in which engaging portion 81*a* was engaged. Thus, the user may move his or her finger off operating portion 81*b* of lever member 81. In this condition, the user further slides second tray 40 on main tray 30 to engage engaging portion 81*a* in either one of openings 83 and 84. As described above, as lever member 81*a* is urged by spring 82 in the direction of arrow B, as shown in FIG. 8, when engaging portion 81*a* is engaged in the desired opening, the user senses a click or snap. Thus, the user receives that confirmation second tray 40 has been slid securely on main tray 30 or second tray 40 and is positioned securely in a service or non-service condition.

After setting second tray 40 in a desired position on main tray 30, the user reinstalls supply tray 15 into body casing 2 from opening 2*a* of image forming apparatus 1, so that an image is formed on a recording medium loaded on the desired tray. Engaging portion 81*a* of lever member 81 engaged in opening 83 or 84 and remains in this position due to spring 82, so that, if supply tray 15 receives an impact or vibration after installation in image forming apparatus 1, second tray 40 will not move. As a result, a reliable, supply tray 15 and image forming apparatus 1 for use with supply tray 15 may be provided.

According to supply tray 15 structured above, second tray 40 is placed and fixed in position with respect to main tray 30. Thus, no matter whether a recording medium is supplied from main tray 30 or second tray 40, the supplying operation is not hindered, so that the recording medium may be supplied reliably. As a result, a recording medium supply from supply tray 15 may be reliably provided.

Because at least a part of locking mechanism 80 is provided in sliding portion 40*a*, instead of pivotable portion 40*b*, of second tray 40, second tray 40 is placed and more stably fixed in position in main tray 30, and the recording mediums also may be supplied reliably. As a result, a more reliable supply tray may be provided. In addition, even when the user pivots pivotable portion 40*b* upward to replenish main tray 30 with recording mediums, second tray 40 may remain locked in place. Thus, after replenishing main tray 30 with the recording mediums, the user returns pivotable portion 40*b* to its original position and returns supply tray 15 in image forming apparatus 1, so that the last service condition of image forming apparatus 1 is restored. Thus, operational ease may be improved.

When a recording medium is supplied from second tray 40, which is slidable on main tray 30, the recording medium may be supplied reliably because the second tray 40 is fixed in place on main tray 30. As a result, supply tray 15 may be reliably provided.

Image forming apparatus 1, as structured above, comprises supply tray 15 that achieves superior reliability, so that stable image formation may be performed.

In image forming apparatus 1 of the embodiment, main tray 30 functions as a first tray, second tray 40 functions as a second tray, and supply tray 15 on which second tray 40 is mounted on main tray 30 functions as a supply tray. Sliding portion 40*a* functions as a sliding portion, pivotable portion 40*b* functions as a pivoting portion, supply unit 50 functions as a supply unit, image recording unit 70 functions as an image formation portion, locking mechanism 80 functions as a locking mechanism, lever member 81 functions as a first engaging portion, spring 82 functions as an urging member, and openings 83, 84 function as a second engaging portion. Lever member 81, operating portion 81*b*, and a mechanism to slide lever member 81 comprise a lock and release mechanism.

In image forming apparatus 1 described in the first embodiment of the invention, lever member 81, spring 82 are provided in sliding portion 40*a* of second tray 40, while openings 83, 84 are provided on sidewall 35 of main tray 30. Nevertheless, the components may provide otherwise. An engaging portion like lever member 81 and an urging spring that urges the engaging portion may be provided on sidewall 35 of main tray 30, and openings like openings 83, 84 may be provided in sliding portion 40*a*. Even with such a configuration or structure, effects similar to those brought about by supply tray 15 of the first embodiment may be understood.

The first embodiment has been described as an example of an inkjet-type image forming apparatus to which the invention is applied, however the invention is not limited to this. The invention may be applied to a laser-type or other image forming apparatus.

The first embodiment discloses second tray 40 configured to receive and store a stack of recording mediums. Nevertheless, a second tray capable of loading only a single recording medium for manual feed thereon may be provided instead.

A second embodiment of the invention is described with reference to FIGS. 9-12.

In the second embodiment, instead of second tray 40 described in the first embodiment, a second tray 100 (FIGS. 11 and 12) is mounted on main tray 30. Second tray 100 comprises a sliding portion 100*a* and a pivotable portion 100*b*. In the second embodiment, elements, except for the second tray 100, are similar to or identical with those described in the first embodiment, and are designated by similar numerals. Thus, the descriptions of those similar or identical elements are omitted here for the sake of brevity.

Figure 9:
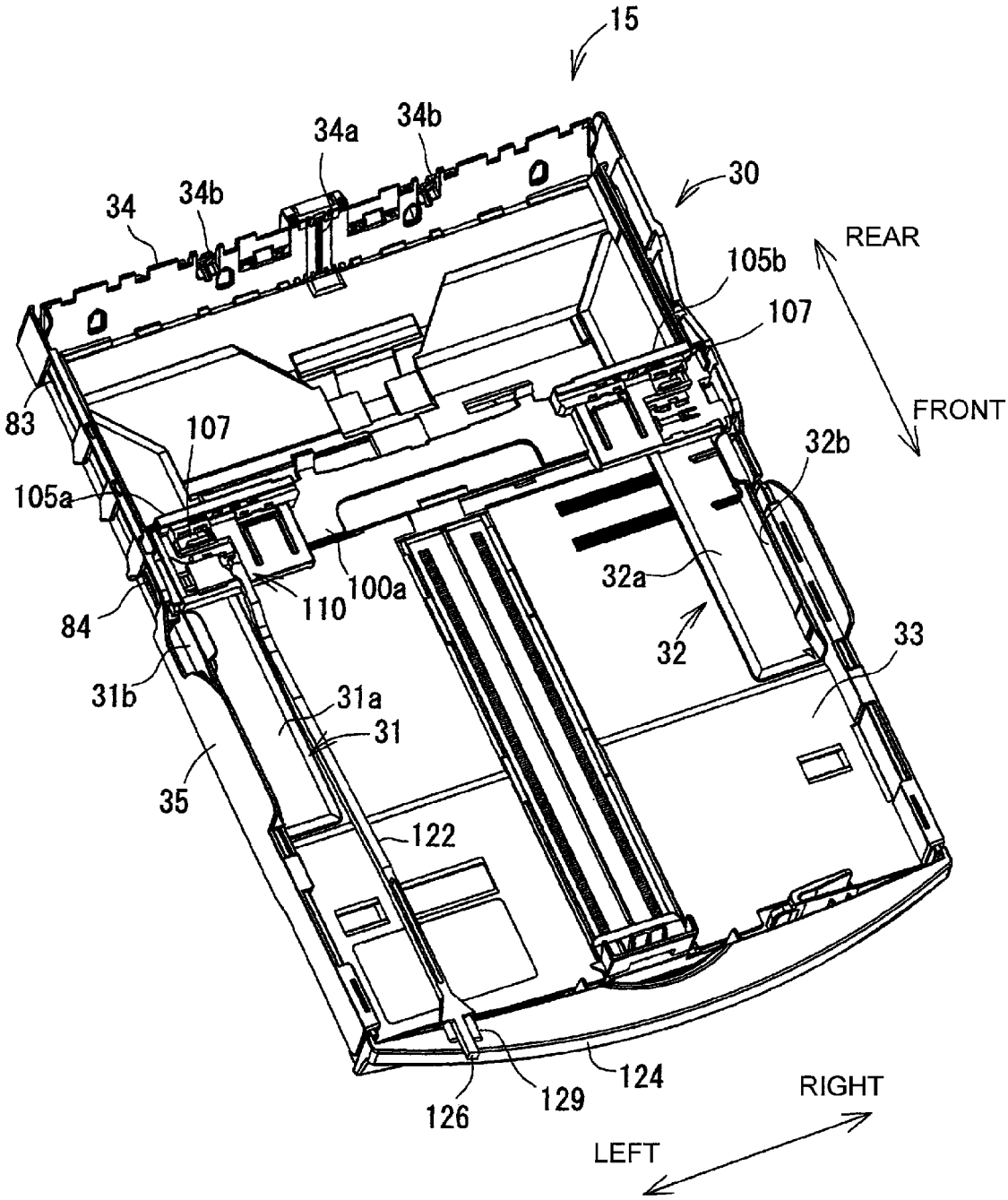
FIG. 9 is a perspective view of a main tray according to another embodiment of the invention, on which a sliding portion is mounted.

As shown in FIG. 9, sliding portion 100*a* includes a locking member 110. Locking member 110 and two openings 83, 84, which are provided on sidewall 35 of main tray 30, comprise a locking mechanism. Sliding portion 100*a* has a substantially similar structure to that of sliding portion 40*a* of the first embodiment, and is slidably engaged with main tray 30. A point of difference between sliding portions 100*a* and 40*a* is that sliding portion 100*a* comprises locking member 110, instead of locking mechanism 80.

As shown in FIG. 9, mounting seats 105*a*, 105*b* are disposed at both ends of the sliding portion 100*a* with respect to the left-right directions. Mounting seats 105*a*, 105*b* are provided with bearings 107, respectively. Rotating shafts 106 provided in pivotable portion 100*b* (FIGS. 11 and 12) are mounted in bearings 107. Thus, pivotable portion 100*b* is pivotally supported on sliding portion 100*a*.

Mounting seat 105*a* located at the left end of sliding portion 100*a* is provided with locking member 110. More specifically, a recessed cavity portion 100*c* is formed in a left half portion of mounting seat 105*a*, and locking member 110 is disposed in cavity portion 100*c*. As is the case with locking mechanism 80, locking member 110 is configured to place second tray 100 in position with respect to main tray 30 and to fix second tray 100 so as to prevent second tray 100 from sliding on the main tray 30.

Figure 10:
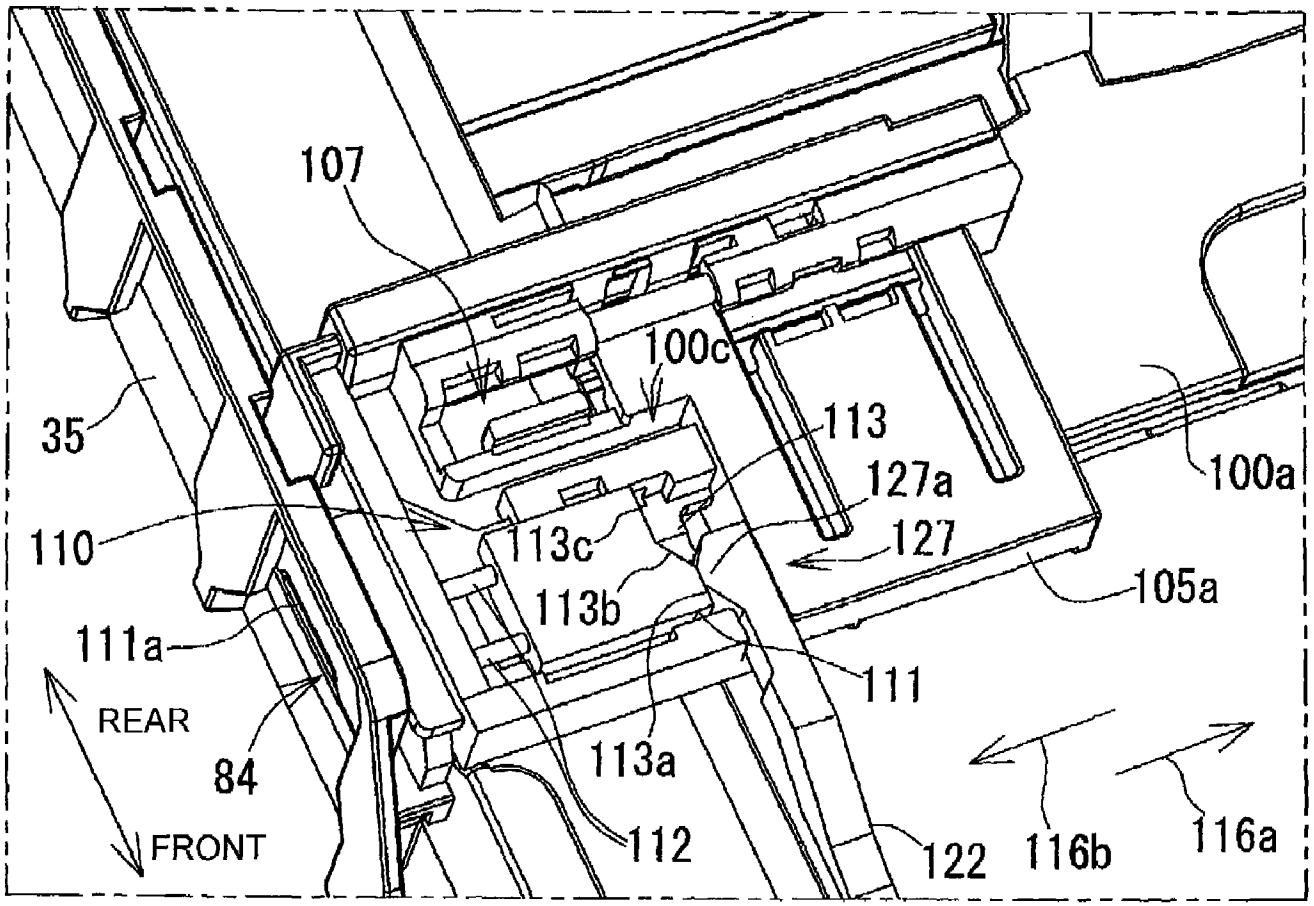
FIG. 10 is a partial, enlarged view of a structure of a locking member.

As shown in FIG. 10, locking member 110 comprises a lever member 111 and an urging spring 112.

Figure 11:
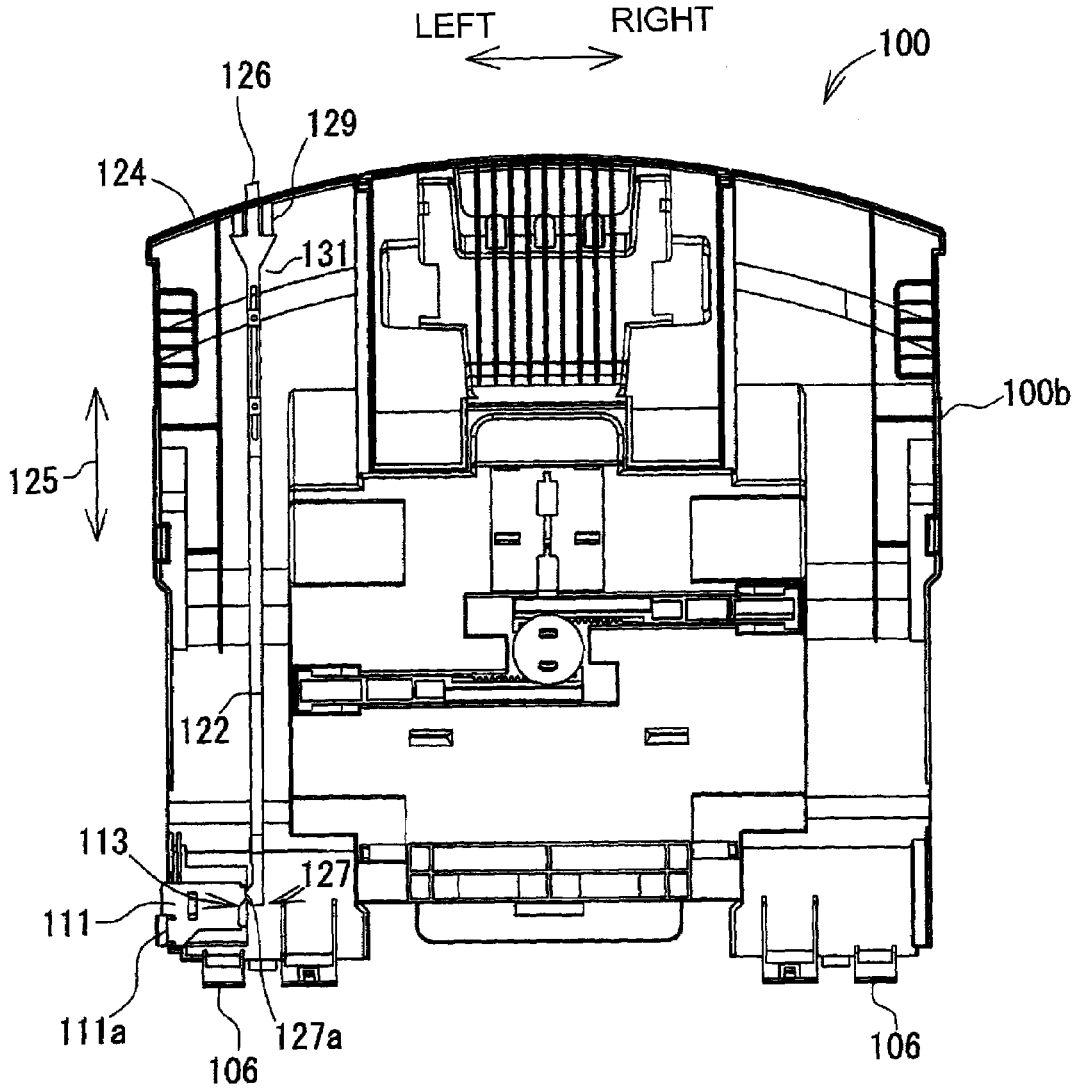
FIG. 11 is a plan view of a rear surface of a pivotable portion of a second tray in which a lever member and an engaging portion extend toward a sidewall of the main tray.

Lever member 111 is disposed to slide in cavity portion 100*c* to the left (e.g., a direction of an arrow 116*b* in FIG. 10) and the right (e.g., a direction of an arrow 116*a* in FIG. 10) of main tray 30. In cavity portion 100*c*, lever member 111 normally is urged by urging member 112 in the direction of the arrow 116*a*. Lever member 111 is provided with an engaging portion 111*a*. Engaging portion 111*a* is formed at the left end portion of lever member 111. In cavity portion 100*c*, in which lever member 111 slides in the direction of arrow 116*b*, lever member 111 protrudes outward from the left end portion of sliding portion 100*a* (e.g., outward from the sidewall 35), as shown in FIG. 11. When lever member 111 slides in the direction of arrow 116*a*, engaging portion 111*a* is hidden in cavity portion 100*c* (FIGS. 10 and 12).

Engaging portion 111*a* is shaped, so that it may be received into openings 83, 84 found on sidewall 35 of main tray 30. Thus, while engaging portion 111*a* is hidden in cavity portion 100*c*, sliding portion 100*a* may be moved. When engaging portion 111*a* is aligned with opening 83 or 84, lever 111 is slid in the direction of arrow 116*b* against urging spring 112, and engaging portion 111*a* is engaged in opening 83 or 84. Thus, sliding portion 100*a* is positioned and fixed in position with respect to main tray 30.

The right side surface (e.g., toward the direction of arrow 116*a*) of lever member 111 is formed with a stepped portion 113. Stepped portion 113 is a position pressed by an operating lever 122. As shown in FIG. 10, stepped portion 113 comprises a flat portion 113*a* that is provided at the front side of lever member 111; an inclined portion 113*b* that is inclined leftward (e.g., in the direction of arrow 116*b*) from the rear end of flat portion 113*a*; and a flat portion 113*c* that extends rearward from the rear end of inclined portion 113*b*. When stepped portion 113 is pressed by operating lever 122, lever member 111 slides and engaging portion 111*a* protrudes from or is hidden in cavity portion 100*c*.

Figure 12:
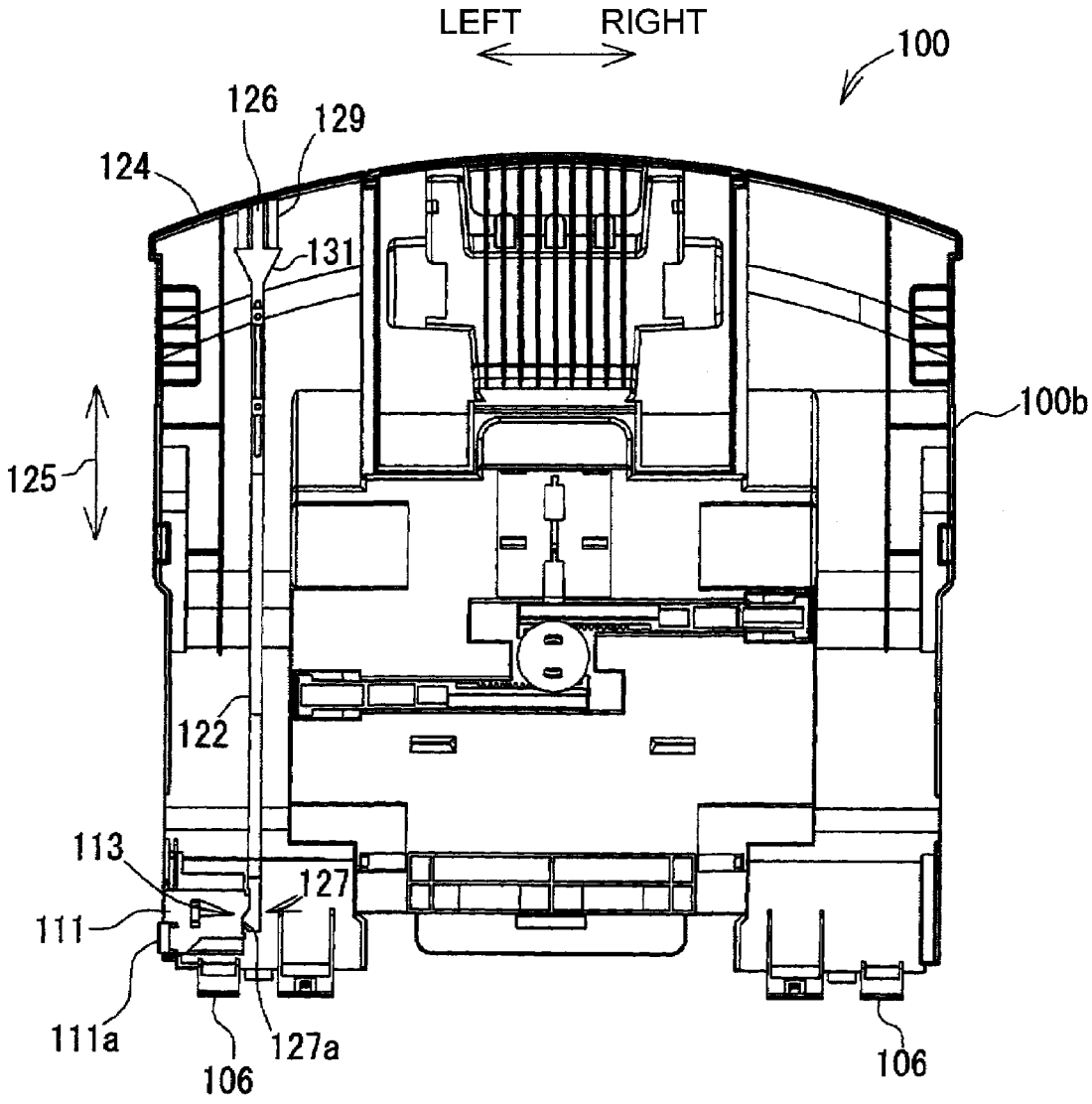
FIG. 12 is a plan view of the rear surface of the pivotable portion in which the lever member and the engaging portion are hidden in a cavity portion.

As shown in FIGS. 9-12, pivotable portion 100*b* is provided with operating lever 122. In FIG. 9, pivotable portion 100*b* is omitted, and operating lever 122 only is illustrated. Operating lever 122 is attached to the rear of lever member 111, as shown in FIGS. 11 and 12. Operating lever 122 and stepped portion 113 of lever member 111 comprise a lock release mechanism.

Operating lever 122 may be a thin, rod-like member, and extends from stepped portion 113 of lever member 111 near to an end 124 of pivotable portion 100*b* on the rear of pivotable portion 100*b*. An end of operating lever 122 near stepped portion 113 is provided with a pressing portion 127 having a protrusion 127*a*. An end of operating lever 122 near end 124 of pivotable portion 110*b*, which is on an upstream side with respect to a direction in which a recording medium is fed by supply roller 60, is provided with a knob 126 operated by the user.

Operating lever 122 is supported on the rear of pivotable portion 100*b* to slide in its longitudinal direction, that is, in directions of arrows 125 in FIGS. 11 and 12. Operating lever 122 is provided so as to slide between a position at which protrusion 127*a* contacts flat portion 113*c* of stepped portion 113 (FIG. 12) and a position at which protrusion 127*a* contacts flat portion 113*a* of stepped portion 113 (FIG. 11). When protrusion 127*a* contacts flat portion 113*c* of stepped portion 113, knob 126 is displaced into a first position at which the knob 126 is hidden within end 124 of pivotable portion 100*b* (FIG. 12). When protrusion 127*a* contacts flat portion 113*a* of stepped portion 113, knob 126 is displaced into a second position from which knob 126 protrudes outwardly from end 124 of pivotable portion 100*b*. In this embodiment, knob 126 is disposed on end 124 of pivotable portion 100*b* in consideration of ease of use. Nevertheless, the position to dispose knob 126 is not limited to the above position. Knob 126 may be disposed in the front end portion of main tray 30.

A pull spring 129 (e.g., a coil spring having hook portions at both ends) is attached to operating lever 122 on a side nearer knob 126. Pull spring 129 is disposed inward from end 124 of pivotable portion 100*b*. More specifically, a spring seat 131 is disposed nearer knob 126, and is connected to one end of pull spring 129 that is fitted around knob 126. The other end of pull spring 129 is connected to a wall surface forming end 124 of pivotable portion 100*b*. Spring tension of pull spring 129 is set greater than that of urging spring 112. Thus, when no external force is applied to knob 126, the contraction force of pull spring 129 exceeds the urging force of urging spring 112. In the second embodiment, operating lever 122 is positioned, so that knob 126 extends outwardly from the end of pivotable portion 100*b* in this state. When an external force is applied to knob 126, pull spring 129 extends, and knob 126 is pressed inwardly from end 124 of pivotable portion 100*b*.

The lock operation and lock release operation in the second embodiment are described below.

In FIG. 10, engaging portion 111*a* engages opening 84, and second tray 100 is locked with respect to main tray 30. In the locking state shown in FIG. 10, lever member 122 remains in the second position at which protrusion 127*a* contacts flat portion 113*a*, as shown in FIG. 11. In this condition, protrusion 127*a* presses flat portion 113*a* against urging spring 112. Thus, lever member 111 is pressed toward the left side of main tray 30, and engaging portion 111*a* continues to protrude outwardly from the left side. In this condition, the locking state shown in FIG. 9 is maintained by inserting engaging portion 111*a* into opening 84.

The locking state shown in FIG. 9 may be released as follows. The user presses knob 126 protruding outwardly from end 124 of pivotable portion 110*b*. Pull spring 129 then extends, and knob 126 is hidden within end 124 of pivotable portion 100*b*, and operating lever 122 slides, so that pressing portion 127 is forced in a direction toward which knob 126 is pressed. In this condition, protrusion 127*a* separates from flat portion 113*a*, and the urging force of urging spring 112 releases. Thus, as shown in FIG. 12, lever member 111 slides rightwardly (i.e., in the direction of arrow 116*a*) until flat portion 113*c* contacts protrusion 127*a*. Engaging portion 111*a* withdraws from opening 84, and is hidden in cavity portion 100*c*. In this manner, the lock of second tray 100 to main tray 30 releases. In particular, second tray 100 becomes slidable on main tray 30.

When the user releases knob 126, pull spring 129 contracts. Because the contraction force of pull spring 129 is set greater than the urging force of urging spring 112, operating lever 122 returns in a direction toward which pull spring 129 contracts due to the contraction of pull spring 129. In this condition, protrusion 127*a* moves from flat portion 113*c* to inclined portion 113*b*. Protrusion 127*a* further moves while forcing inclined portion 113*b* leftward (i.e., in the direction of arrow 116*b*), and reaches flat portion 113*a*. During this movement, lever member 111 slides leftward, so that engaging portion 111*a* protrudes outwardly from the left side.

When the locking state shown in FIG. 9 releases, second tray 100 slides, for example, backward on main tray 30, and the user releases knob 126. Engaging portion 111*a* is no longer inserted into opening 84 and contacts sidewall 35. In this condition, when second tray 100 slides further rearward until the rear end of second tray 100 contacts bank 34, engaging portion 111*a* inserts into opening 83 due to the urging force of urging spring 112. Thus, second tray 100 is locked again with respect to main tray 30.

In the first embodiment, to release the locking state of second tray 40 with respect to main tray 30, supply tray 15 is removed from image forming apparatus 1, and then lever member 81 is slid in the direction of arrow A of FIG. 8. In the second embodiment, however, the user may operate knob 126 from the first position to the second position with supply tray 15 remaining installed in image forming apparatus 1, so that the locking state of second tray 100 with respect to main tray 30 may be released readily. Thus, while supply tray 15 remains installed in image forming apparatus 1, second tray 100 may slide to a desired position on main tray 30.

In the second embodiment, second tray 100 functions as a second tray, sliding portion 100*a* functions as a sliding portion, pivotable portion 100*b* functions as a pivotable portion, lever member 111 functions as a first engaging portion, urging spring 112 functions as an urging member, and knob 126 of operating lever 122 functions as an operating member. Locking member 110 and openings 83, 84 comprise a locking mechanism. Operating lever 122 and stepped portion 113 comprise a lock release mechanism. Stepped portion 113 and protrusion 127*a* comprise a link mechanism.

A third embodiment of the invention now is described with reference to FIGS. 13-16.

In the third embodiment, instead of second tray 40 described in the first embodiment, a second tray 150 (FIG. 13) is mounted on main tray 30. Second tray 150 comprises a sliding portion 150*a* and a pivotable portion 150*b*. In the third embodiment, elements, except for second tray 150, are similar or identical to those described in the first embodiment, and are designated by similar numerals. Thus, the descriptions of such similar or identical elements are omitted here for the sake of brevity.

Figure 13:
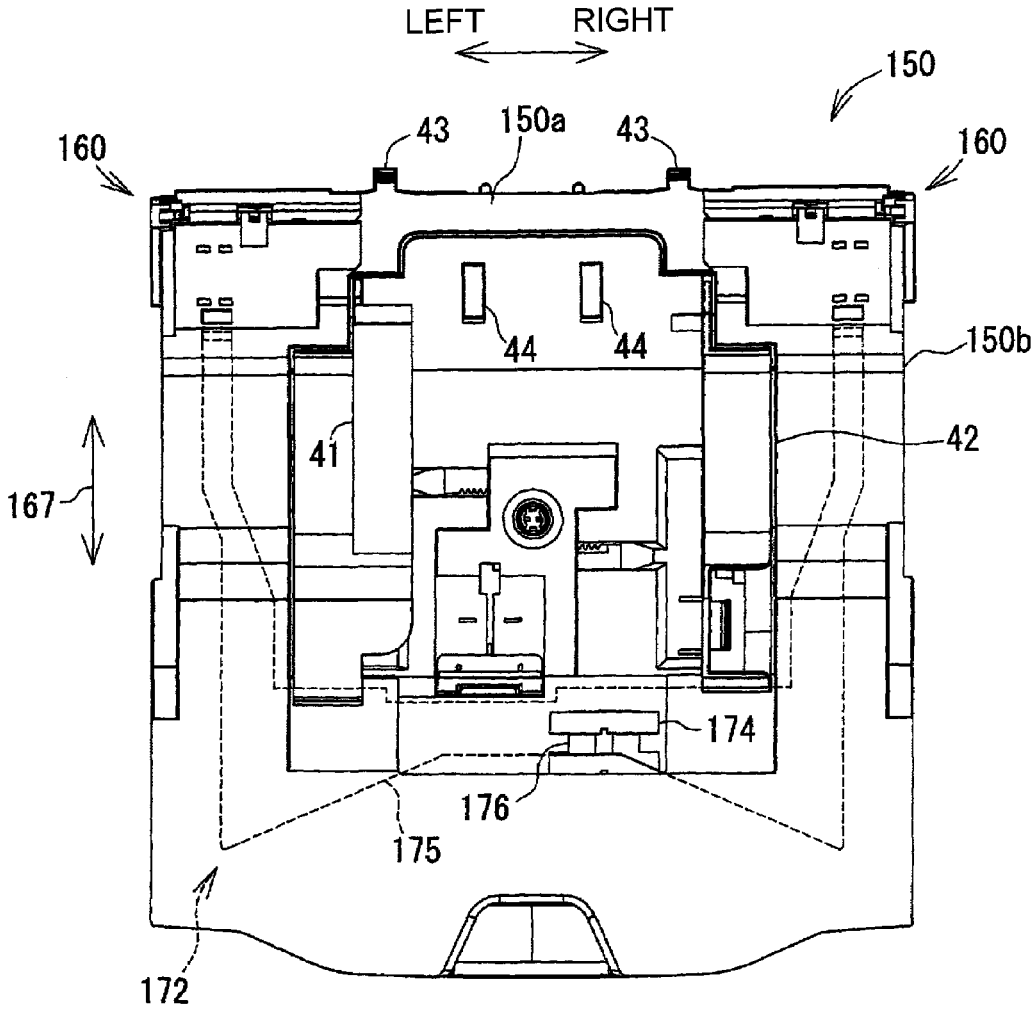
FIG. 13 is a plan view of a second tray according to yet another embodiment of the invention.

As shown in FIG. 13, sliding portion 150*a* includes two locking members 160. Each sidewall 35 of main tray 30 is provided with openings 83 and 84. Locking members 160 and openings 83, 84 comprise a locking mechanism. Sliding portion 150*a* has a substantially similar structure to that of sliding portion 40*a* of the first embodiment, and slidably engages with main tray 30. Nevertheless, a point of difference between sliding portions 150*a* and 40*a* is that sliding portion 150*a* includes two locking members 160, instead of locking mechanism 80.

Figure 14:
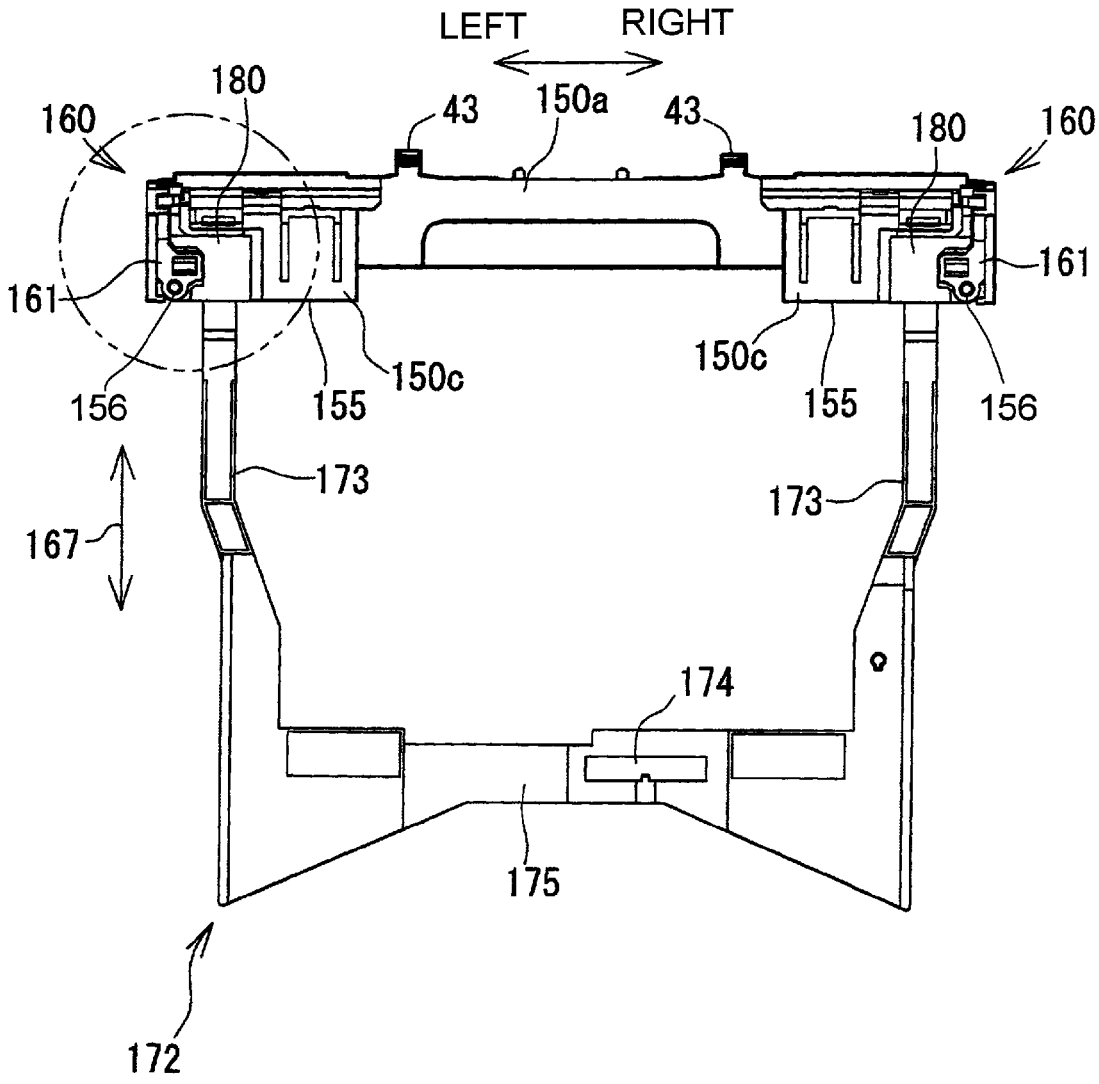
FIG. 14 is a plan view showing a sliding portion and an operating lever.

As shown in FIG. 14, mounting seats 155 are disposed at both ends of sliding portion 150*a* with respect to the left-right directions. Locking members 160 are disposed on corresponding mounting seats 155. More specifically, cavity portions 150*c* are provided in interior portions of corresponding mounting seats 155, and locking members 160 are disposed in cavity portions 150*c*. As with locking mechanism 80 and locking member 110, locking members 160 are configured to place second tray 150 in position with respect to main tray 30 and to fix second tray 150 so as to prevent second tray 150 from sliding on main tray 30.

Each locking member 160 comprises a lever member 161 and a shaft 156 that supports lever member 161.

Figure 16B:
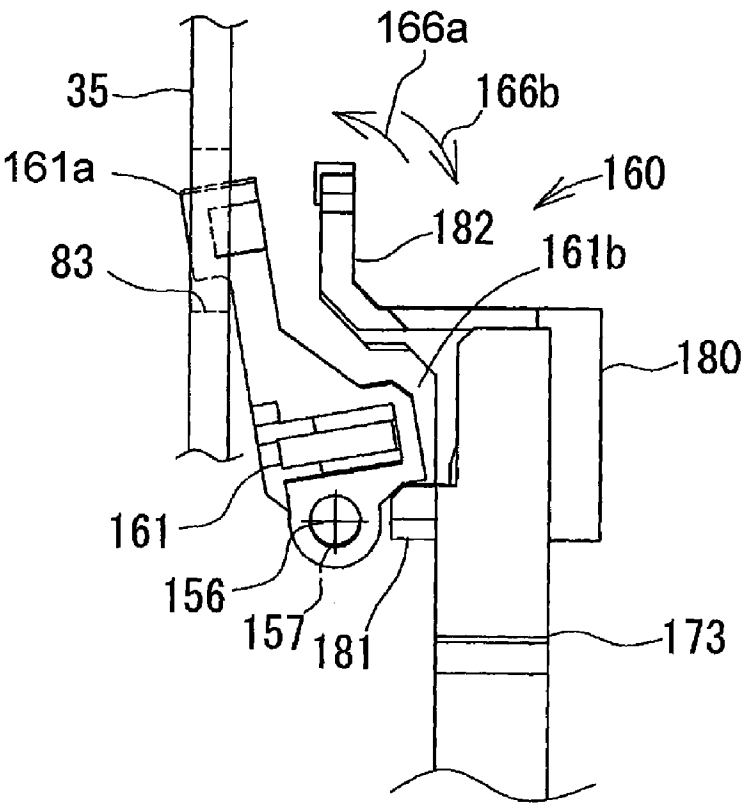
FIG. 16B is a partial, enlarged view of the left-side locking member and the associated elements in which the engaging portion is inserted in the opening.
Figure 16A:
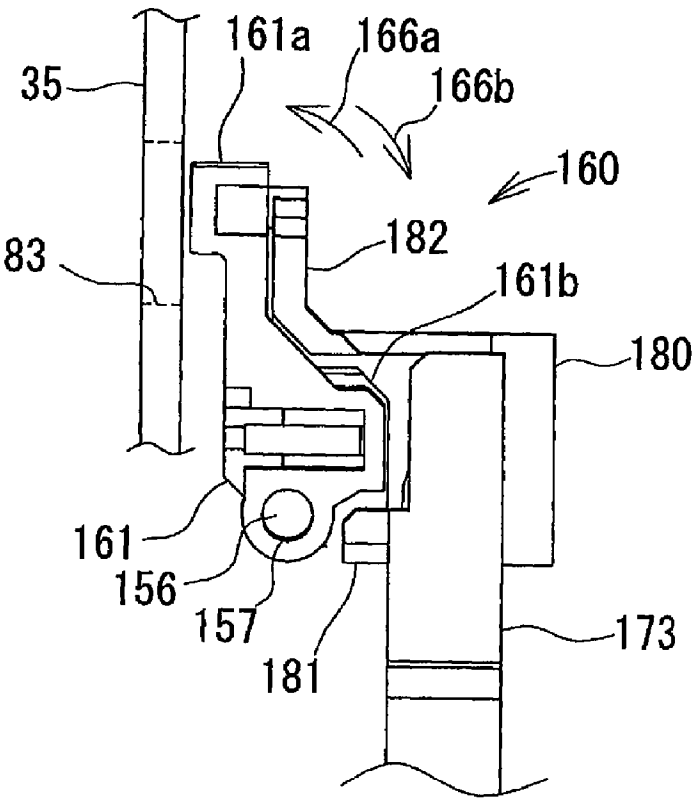
FIG. 16A is a partial, enlarged view of a left-side locking member and associated elements in which an engaging portion is withdrawn from an opening.

FIGS. 16A and 16B illustrate a structure of the left-side locking member 160 enclosed by a double dotted chain line in FIG. 14. As shown in the drawings, lever member 161 comprises a bearing hole 157 formed therein. Shaft 156 stands on mounting seat 155, and is inserted into bearing hole 157. Thus, lever member 161 is supported pivotably on shaft 156. Lever member 161 comprises an engaging portion 161*a*. Engaging portion 161*a* is formed on the outer side of lever member 161. Engaging portion 161*a* is shaped in a size to be received into openings 83 and 84. In cavity portion 150*c*, when lever member 161 is pivoted on shaft 156 in a direction of an arrow 166*a*, engaging portion 161*a* is moved from cavity portion 150*c* and protrudes beyond from left sidewall 35, as shown in FIG. 16B. In this condition, engaging portion 161*a* is inserted into opening 83 or 84, and sliding portion 150*a* is positioned and fixed in place with respect to main tray 30, i.e., second tray 150 is locked. On the other hand, when lever member 161 is pivoted on shaft 156 in a direction of an arrow 166*b*, engaging portion 161*a* is withdrawn from opening 83 or 84 and hidden in cavity portion 150*c*, as shown in FIG. 16A, i.e., the locking state of second tray 150 is released. Right-side locking member 160 is similar to Left-side locking member 160, and, thus, the description thereof is omitted here for the sake of brevity.

Lever member 161 comprises a protrusion 161*b*. Protrusion 161*b* is provided so as to protrude toward a center of second tray 150 with respect to bearing hole 157. Protrusion 161*b* is a portion pressed by a link member 180 (FIG. 14). Protrusion 161*b* protrudes toward the center of second tray 150 when engaging portion 161*a* does not engage in the opening 83 or 84 as shown in FIG. 16A. Protrusion 161*b* is pressed by link member 180, and lever member 161 is pivoted on shaft 156.

Figure 15:
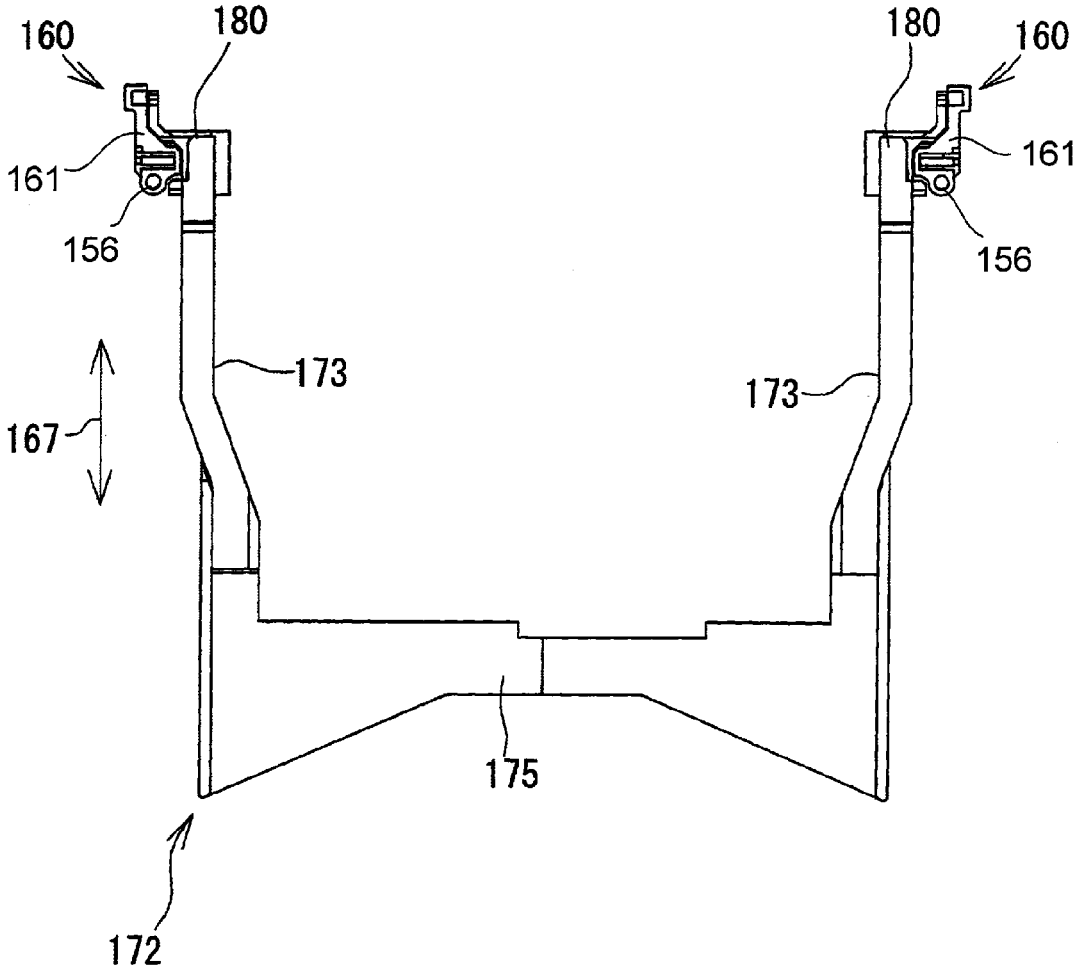
FIG. 15 is a rear view of a link mechanism comprising lever members and the operating.

As shown in FIG. 13, a pivotable portion 150*b* is provided with an operating lever 172. As shown in FIGS. 14 and 15, operating lever 172 comprises two link members 180 in correspondence with lever members 161. Operating lever 172 and link members 180 comprise a lock release mechanism.

Operating lever 172 is a substantially U-shaped, and comprises a base portion 175 and two arms 173. Arms 173 extend from both ends of base portion 175 in parallel with each other. Operating lever 172 is supported so as to slide in directions indicated by arrows 167, as shown in FIGS. 13 and 14. In the third embodiment, operating lever 172 slides in an operating range while lever members 161 pivot from a position shown in FIG. 16A to a position shown in FIG. 16B. The position of operating lever 172 when lever members 161 are pivoted to the position shown in FIG. 16A is a first position, and the position of operating lever 172 when lever members 161 are pivoted to the position shown in FIG. 16B is a second position.

A knob 174 is disposed in base portion 175. Knob 174 extends vertically from base portion 175 (e.g., in a direction vertical to the sheet of FIG. 14). As shown in FIG. 13, knob 174 is exposed from the rear surface of second tray 150 to the front surface thereof through a through hole 176 formed in a tray surface of second tray 150.

As shown in FIG. 14, link members 180 are connected to the ends of arms 173. Arms 173 engage with protrusions 161*b* via link members 180. As shown in FIGS. 16A and 16B, link member 180 is shaped in correspondence with a shape of a side of lever member 161 at which protrusion 161*b* is disposed. Link member 180 comprises protrusions 181 and 182 on a side opposing the side of lever member 161. Protrusions 181 and 182 are separated from each other in a longitudinal direction of arm 173, and are disposed to bracket protrusion 161*b* vertically. When link member 180 is moved upward (i.e., toward the rear of supply tray 15) in condition shown in FIG. 16A, protrusion 181 contacts protrusion 161*b*, as shown in FIG. 16B, and protrusion 161*b* receives a pivoting force in the direction of arrow 166*a*. When link member 180 is moved downward (i.e., toward the front of supply tray 15) in a condition shown in FIG. 16B, protrusion 182 contacts protrusion 161*b*, as shown in FIG. 16A, and protrusion 161*b* receives a pivoting force in the direction of arrow 166*b*.

Because locking members 160 and operating lever 172 are provided with such a structure, the user may lock second tray 150 to main tray 30 or release the locking only by operating knob 174 to slide operating lever 172. When second tray 150 is locked, two lever members 161 are fitted in corresponding openings 83 or 84. Thus, second tray 150 is locked securely to main tray 30.

In the third embodiment, second tray 150 functions as a second tray, sliding portion 150*a* functions as a sliding portion, pivotable portion 150*b* functions as a pivotable portion, lever members 160 function as a first engaging portion, and knob 174 functions as an operating member. Lever members 160 and openings 83 and 84 comprise a locking mechanism, and operating lever 172 and link members 180 comprise a lock release mechanism. Protrusions 161*a* and 161*b* and link members 180 comprise a link mechanism.

A fourth embodiment of the invention now is described with reference to FIGS. 17-20.

Figure 17:
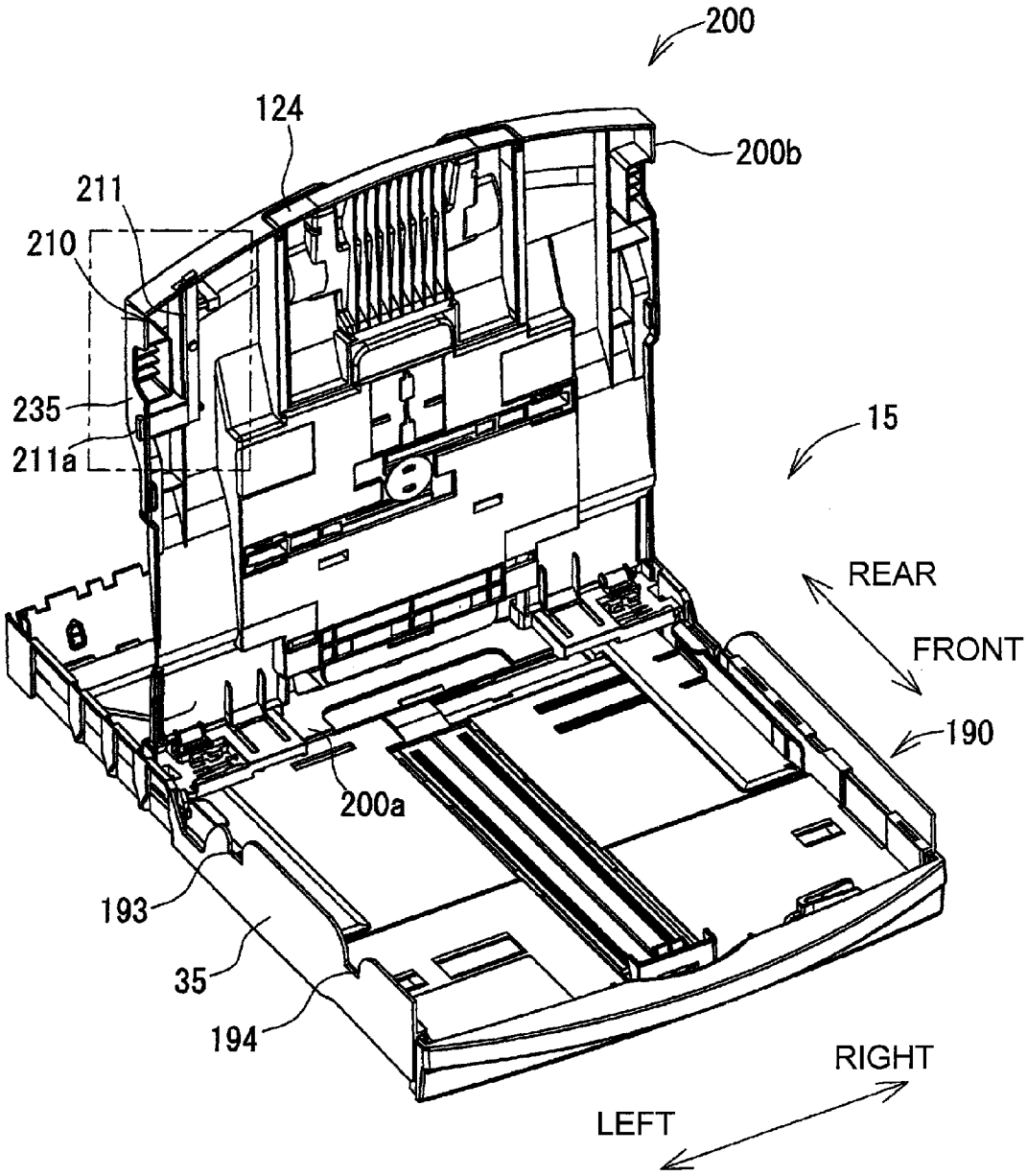
FIG. 17 is a perspective view of a supply tray according to still another embodiment of the invention, in which a pivotable portion of a second tray is pivoted upwards.

In the fourth embodiment, supply tray 15 comprises a main tray 190 and a second tray 200, as shown in FIG. 17.

On left sidewall 35 of main tray 190, two notches 193, 194 are formed therein, instead of openings 83, 84 of the first embodiment. An engaging portion 211*a* of a lever member 211, which is described below, is selectively inserted into one of notches 193, 194. As with openings 83, 84 of the first embodiment, notches 193, 194 are disposed in positions corresponding to positions of a pivotable portion 200*b* when in in-service conditions and non-service conditions. More specifically, when pivotable portion 200*b* is at in-service condition, engaging portion 211*a* is disposed in notch 193. When pivotable portion 200*b* is at a non-service condition, engaging portion 211*a* is disposed in the notch 194.

Notches 193, 194 are open at the upper edge of left sidewall 35, as shown in FIG. 17. Notches 193, 194 are shaped, such that they widen toward the upper end of left sidewall 35. More specifically, as shown in FIG. 20, each notch 193, 194 is curved along a convex arc extending from a bottom portion 195 of notch 193, 194 toward the upper edge of sidewall 35. A point of difference between main tray 190 of this embodiment and main tray 30 of the first embodiment is that main tray 190 comprises notches 193, 194, instead of openings 83, 84. In main tray 190, elements, except for the notches 193, 194, are similar or identical to those described in main tray 30, and, thus, the descriptions of those similar or identical elements are omitted here for the sake of brevity.

As shown in FIG. 17, second tray 200 includes a locking member 210. Locking member 210 is disposed in pivotable portion 200*b*. In this respect, the fourth embodiment is different from the first, second, and third embodiments. As with sliding portion 40*a*, a sliding portion 200*a* slidably engages main tray 190. A difference between sliding portion 200*a* and sliding portion 40*a*, however, is that sliding portion 200*a* does not comprise the locking mechanism, but other elements of sliding portion 200*a* are common to sliding portion 40*a*. Pivotable portion 200*b* is mounted pivotally on sliding portion 200*a*, as with pivotable portion 40*b* of the first embodiment. A point of difference between pivotable portions 200*b* and 40*b* is that pivotable portion 200*b* comprises locking member 210, but the other elements of pivotable portion 200*b* are common to pivotable portion 40*b*. Thus, the following description of the structure of locking member 210 is provided, and, thus the description of elements of sliding portion 200*a* and pivotable portion 200*b* are omitted for the sake of brevity.

Figure 18:
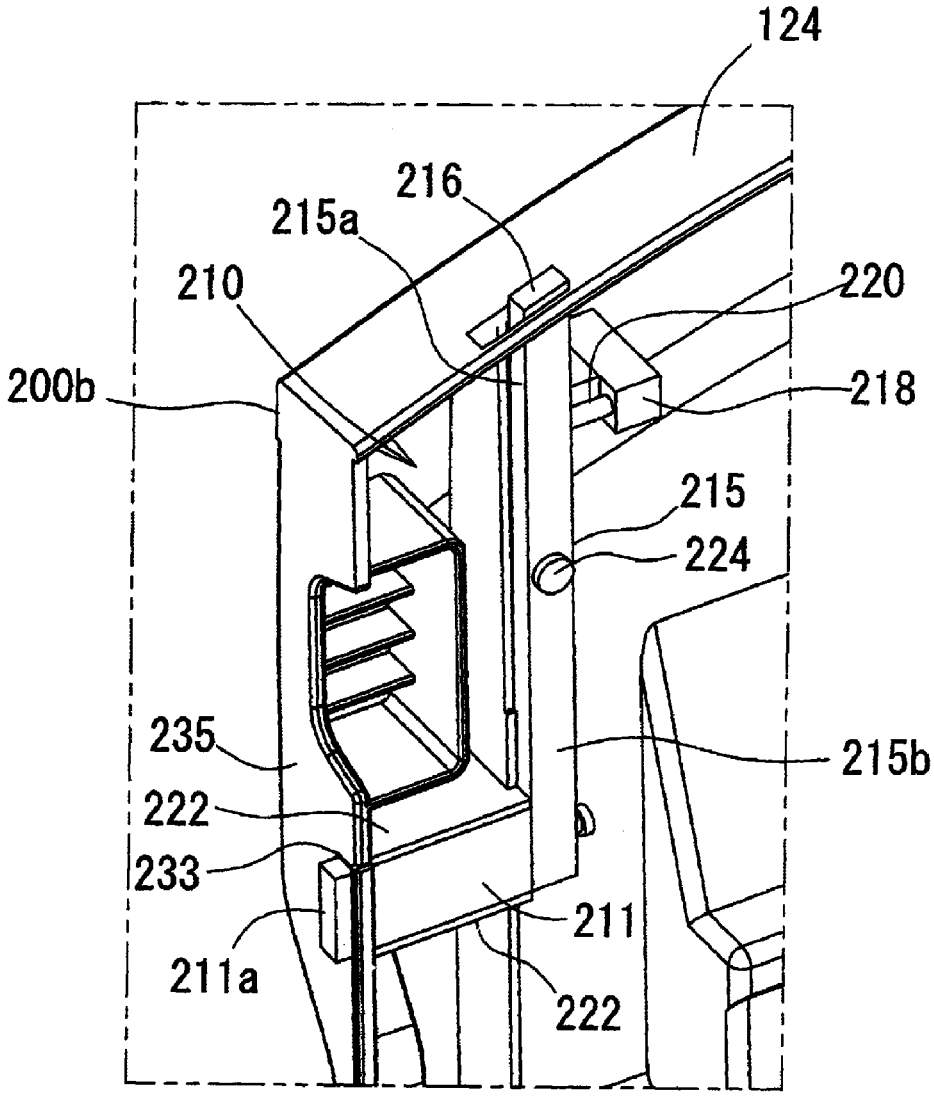
FIG. 18 is an enlarged view of a locking member and associated elements.

Locking member 210 is configured to place second tray 200 in position with respect to main tray 190 and to fix the second tray 200, thereby preventing it from sliding on main tray 190, as with locking mechanism 80 and locking members 110 and 160, described above. Elements surrounding locking member 210 and enclosed by a double dotted line in FIG. 17 are shown in detail in FIG. 18. As shown in FIG. 18, locking member 210 comprises an operating lever 215, a lever member 211, two slide guides 222, a pull spring 220, and a spring seat 218. Locking member 210 is disposed on the rear of pivotable portion 200*b*. Specifically, locking member 210 is disposed at a left end portion nearer end 124 of pivotable portion 200*b*. Locking member 210 and two notches 193, 194 formed within sidewall 35 of main tray 190 comprise a locking mechanism. Operating lever 215 of locking member 210 comprises a lock release mechanism.

Figure 19B:
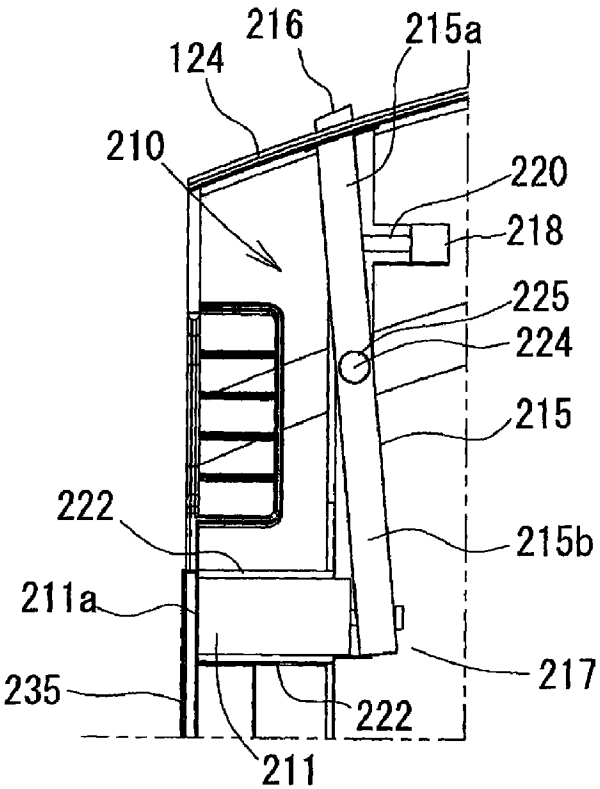
FIG. 19B is a partial, plan view of the lever member, in which the engaging portion is hidden within the left sidewall.
Figure 19A:
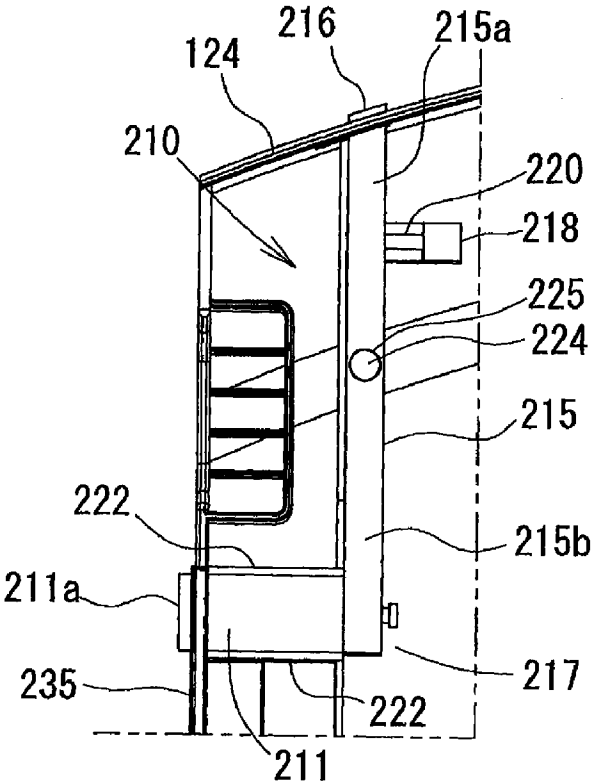
FIG. 19A is a partial plan view of a lever member, in which an engaging portion extends outwardly toward a left sidewall.

Lever member 211 is supported by pivotable portion 200*b* to slide in the left-right directions thereof. Specifically, lever member 211 is disposed in a space enclosed between two, rib-like shaped, slide guides 222 extending in the left-right directions on the rear of pivotable portion 200*b* and being arranged thereon in a standing condition. Thus, lever member 211 is configured to slide along slide guides 222. Lever member 211 comprises an engaging portion 211*a*. Engaging portion 211*a* is formed at the left end of lever member 211. A through hole 233 is formed in a left sidewall 235 of pivotable portion 200*b*. Through hole 233 is disposed on left sidewall 235 in position to face engaging portion 211*a* of lever member 211. When an external force is applied to lever member 211 lever member 211 may slide in a range from a position to protrude engaging portion 211*a* beyond left sidewall 235 (FIG. 19A) to a position to hide engaging portion 211*a* within left sidewall 235 (FIG. 19B). FIGS. 17 and 18 illustrate that the engaging portion 211*a* protrudes beyond left sidewall 235.

Operating lever 215 may be a thin rod-like member. Operating lever 215 is disposed pivotally on the rear of pivotable portion 200*b*. More specifically, a shaft 224 extends from the rear of pivotable portion 200*b*, and a bearing hole 225 is provided in a substantially central portion with respect to the length of operating lever 215. Shaft 224 is received into through hole 225, and, thus lever member 211 is supported to pivot on shaft 224. An end of an arm 215*a*, disposed on a side toward end 124 from shaft 224, protrudes beyond end 124, and comprises a knob 216, by which the user may manipulate operating lever 211. An end 217 of an arm 215*b* is provided on a side of shaft 224 opposite to arm 215*a*. End 217 of arm 215*b* is connected to an end of lever member 211 in the direction that lever member 211 slides. Thus, when the user moves knob 216 in the left or right direction, lever member 211 slides in the opposite direction. In this condition, the sliding motion of lever member 211 causes engaging portion 211*a* to extend beyond left sidewall 235.

Arm 215*a* of operating lever 215 comprises pull spring 220 that urges arm 215*a* in a direction such that arm 215*a* is separated from left sidewall 135. Spring seat 218 is disposed on the rear of pivotable portion 200*b*, one end of pull spring 220 is connected to arm 215*a*, and the other end is connected to spring seat 218. Knob 216 is urged to the right (i.e., away from left sidewall 235) by pull spring 220. Thus, when no external force is applied to pull spring 220, lever member 211 is urged to a position to extend beyond left sidewall 235. On the other hand, when an external force is applied to knob 216 in a direction to extend pull spring 220 (i.e., to draw pull spring 220 toward left sidewall 235), the lever member 211 is withdrawn within left sidewall 235.

With respect to locking member 210 structured as described above, when the user operates knob 216 with pivotable portion 200*b* being pivoted to a position close to main tray 190, second tray 200 may be locked to main tray 190 or the locking mechanism may be released.

In supply tray 15 structured as described above, while second tray 200 is close to main tray 190, sliding portion 200*a* is locked, but pivotable portion 200*b* is unlocked. Thus, when pivotable portion 200*b* is pivoted upward, sliding portion 200*a* remains locked to main tray 190.

Figure 20A:
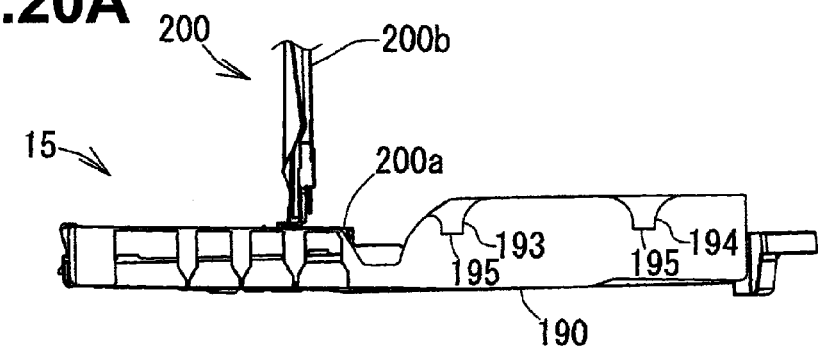
FIGS. 20A to 20D are cross-sectional views each showing a process, in which the pivotable portion is pivoted downward.
Figure 20B:
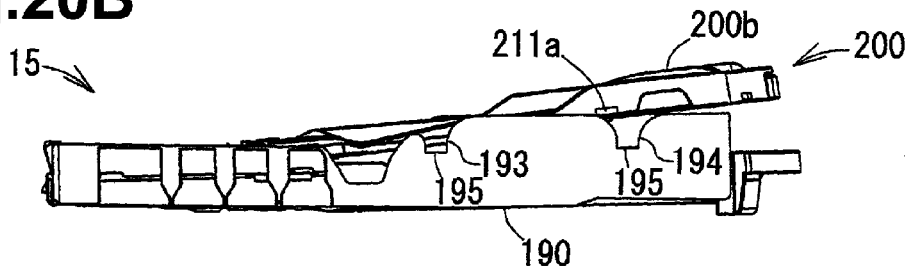
Figure 20C:
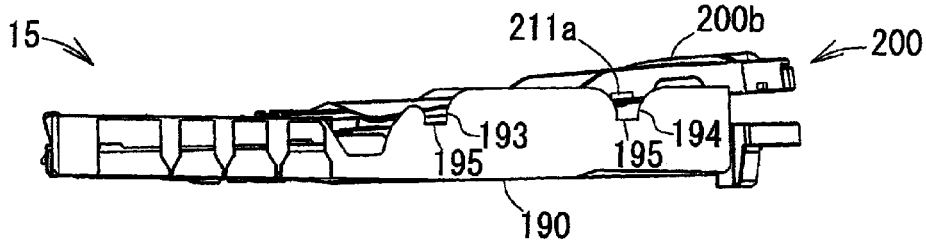
Figure 20D:
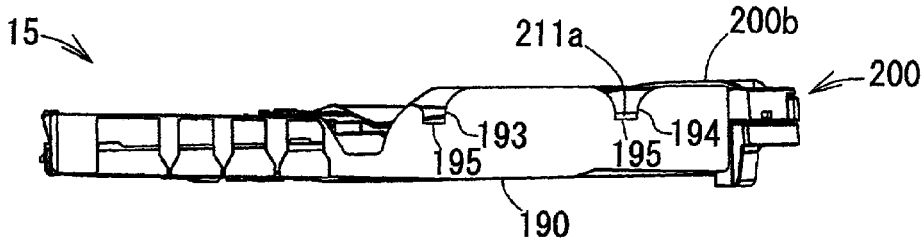

Nevertheless, when pivotable portion 200*b* is pivoted from a position at which pivotable portion 200*b* is pivoted about 90° from its original position (FIG. 20A), while engaging portion 211*a* continues to extend beyond sidewall 235, engaging portion 211*a* engages notch 193 or 194. Thus, second tray 200 is positioned and fixed in place with respect to the sliding direction of sliding portion 200*a*. When pivotable portion 200*b* returns to its original position, engaging portion 211*a* and notch 193, 194 may be slightly misaligned, as shown in FIGS. 20B and 20C. Because notches 193, 194 are formed to spread (or open) wider toward the upper end of sidewall 235, engaging portion 211*a* may be readily guided into notches 193, 194, as shown in FIG. 20D.

In the fourth embodiment, main tray 190 functions as a first tray, second tray 200 functions as a second tray, sliding portion 200*a* functions as a sliding portion, pivotable portion 200*b* functions as a pivotable portion, lever member 211 functions as a third engaging portion, notches 193, 194 function as fourth engaging portions, and knob 216 of operating lever 215 functions as an operating member. Locking member 210 and notches 193, 194 comprise a locking mechanism, and operating lever 216 comprises a lock release mechanism. Operating lever 216, shaft 224, and lever member 211 comprise a link mechanism.

Although notches 193, 194 are described with respect to the fourth embodiment, through holes similar to the openings 83, 84 of the first embodiment may be substituted for notches 193, 194. According to the supply tray described above, the second tray may be fixed in position with respect to the main tray. Thus, regardless whether a recording medium is supplied from the main tray or the second tray, the supplying operation is not hindered, so that the recording medium may be supplied reliably. As a result, a reliable supply tray may be provided.

Although embodiments of the present invention have been described in detail herein, the scope of the invention is not limited thereto. It will be appreciated by those skilled in the art that various modifications may be made without departing from the scope of the invention. Accordingly, the embodiments disclosed herein are only exemplary. It is to be understood that the scope of the invention is not to be limited thereby, but is to be determined by the claims which follow.

What is claimed is:

1. A supply tray for use in an image forming apparatus comprises:

a first tray configured to receive a stack of first recording mediums thereon, a second tray disposed in an upper portion of the first tray, such that the second tray is slidable in a predetermined direction, the second tray configured to receive at least one, second recording medium thereon, wherein the first recording medium is a different size, or type, or both, from the second recording medium; and a locking mechanism disposed at a side of the second tray parallel to the predetermined direction and configured to couple and hold the second tray at a predetermined position with respect to the first tray, and to inhibit the second tray from sliding in the predetermined direction and a direction opposite to the predetermined direction.

2. The supply tray according to claim 1, wherein the second tray comprises:

a sliding portion which slidably engages the first tray; and a pivotable portion configured to pivot on the sliding portion and to receive the at least one, second recording medium thereon, and wherein at least a portion of the locking mechanism is disposed on the sliding portion.

3. The supply tray according to claim 2, wherein the locking mechanism comprises:

a first engaging portion;

an urging member configured to urge the first engaging portion in a direction orthogonal to a sliding direction of the sliding portion; and a second engaging portion engageable with the first engaging portion to couple and hold the sliding portion in position with respect to the first tray, and wherein the first engaging portion and the urging member are disposed on the sliding portion, and the second engaging portion is disposed on the first tray.

4. The supply tray according to claim 3, wherein the first engaging portion comprises a lever member provided on an end portion of the sliding portion in the direction orthogonal to the sliding direction, and the second engaging portion comprises a plurality of openings formed in the first tray.

5. The supply tray according to claim 3, wherein the first engaging portion comprises a pair of lever members provided on either end of the sliding portion in the direction orthogonal to the sliding direction, and the second engaging portion comprises a plurality of openings formed in the first tray.

6. The supply tray according to claim 1, wherein the second tray is held at the predetermined position with respect to the first tray at which at least one, second recording medium is supplied from the second tray.

7. The supply tray according to claim 1, wherein the second tray comprises:

a sliding portion which slidably engages the first tray; and a pivotable portion configured to pivot on the sliding portion and to receive the at least one, second recording medium thereon, and wherein the locking mechanism comprises:

a third engaging portion disposed on the pivotable portion;

an urging member provided on the pivotable portion, wherein the urging member is configured to urge the third engaging portion in a direction orthogonal to a sliding direction of the sliding portion; and a fourth engaging portion formed in a sidewall of the first tray, such that the fourth engaging portion is engageable with the third engaging portion, wherein the fourth engaging portion proximate to an upper end of the sidewall of the first tray is wider than the fourth engaging portion distal from the upper end of the sidewall of the first tray.

8. The supply tray according to claim 7, wherein the fourth engaging portion describes an arc between a bottom portion of the upper end of the sidewall of the first tray and the upper end of the sidewall of the first tray.

9. The supply tray according to claim 1, further comprising a lock release mechanism configured to unlock the second tray by the locking mechanism.

10. The supply tray according to claim 9, wherein the lock release mechanism includes an operating member configured to be displaced between a first position and a second position, such that the lock release mechanism unlocks the locking mechanism when the operating member is displaced into the first position, and locks the locking mechanism when the operating member is displaced into the second position.

11. The supply tray according to claim 10, wherein the lock release mechanism includes a link mechanism configured to link the locking mechanism with the lock release mechanism and to move in a direction to unlock the locking mechanism when the operating member is displaced from the first position into the second position.

12. The supply tray according to claim 11, wherein the operating member is disposed adjacent an end of the supply tray opposite a direction to which the first or second recording medium is fed from the supply tray.

13. An image forming apparatus comprising:

the supply tray of claim 1;

a supply unit configured to selectively supply the first recording medium received on the first tray or the at least one, second recording medium received on the second tray in response to a position of the second tray; and an image formation portion configured to form an image on the first or second recording medium supplied by the supply unit.

14. The supply tray according to claim 1, wherein the locking mechanism comprises an engaging portion and an engaged portion configured to engage the engaging portion, the engaging portion engages the engaged portion when the second tray is held at the predetermined position with respect to the first tray, and the engaging portion disengages the engaged portion when the second tray is separated from the predetermined position.

15. The supply tray according to claim 14, wherein the engaging portion comprises a protrusion and the engaged portion has an opening formed therein, and wherein the protrusion engages the opening when the second tray is held at the predetermined position with respect to the first tray.

16. The supply tray according to claim 14, wherein the engaging portion comprises a protrusion and a spring, and the spring is configured to urge the protrusion toward the engaged portion.

17. A supply tray comprising:

a first tray configured to receive a recording medium;

a second tray mounted on the first tray, wherein the second tray is configured to receive a recording medium and to slide between a first position and a second position with respect to the first tray;

an engaging portion; and a first and a second engaged portion configured to engage with the engaging portion, wherein the engaging portion engages the first engaged portion when the second tray is positioned at the first position and the engaging portion engages the second engaged portion when the second tray is positioned at the second position, and the engaging portions disengages from the first engaged portion and the second engaged portion when the second tray is positioned at a predetermined position between the first position and the second position.

18. The supply tray according to claim 17, wherein the engaging portion comprises a protrusion, and each of the first engaged portion and the second engaged portion has an opening formed therein, and wherein the protrusion engages the opening of one of the first engaged portion and the second engaged portion when the second tray is positioned at one of the first and the second position.

19. The supply tray according to claim 17, wherein the engaging portion comprises a protrusion and a spring, and the spring is configured to urge the protrusion toward the engaged portion when the second tray is positioned at one of the first and the second position.

20. The supply tray according to claim 17, wherein the engaging portion is positioned at the second tray, and the first engaged portion and the second engaged portion are positioned at the first tray.

21. The supply tray according to claim 20, wherein the second tray comprises:

a sliding portion which slidably engages the first tray; and a pivotable portion configured to pivot on the sliding portion and to receive the recording medium, wherein the engaging portion is disposed on the sliding portion.

22. The supply tray according to claim 17, wherein an upstream end of the second tray in a sheet feeding direction is not farther from a downstream end of the first tray in the sheet feeding direction than an upstream end of the first tray in the sheet feeding direction when the second tray selectively slides between the first position and the second position.

23. The supply tray according to claim 1, wherein an upstream end of the second tray in the predetermined direction is not farther from a downstream end of the first tray in the predetermined direction than an upstream end of the first tray in the predetermined direction when the second tray selectively slides in the predetermined direction and the direction opposite to the predetermined direction.

* * * * *